US012338622B2

(12) United States Patent
LeBlang

(10) Patent No.: US 12,338,622 B2
(45) Date of Patent: Jun. 24, 2025

(54) ADJUSTABLE METAL FRAMING SYSTEM AND CONNECTON

(71) Applicant: Dennis LeBlang, Palm Desert, CA (US)

(72) Inventor: Dennis LeBlang, Palm Desert, CA (US)

( * ) Notice: Subject to any disclaimer, the term of this patent is extended or adjusted under 35 U.S.C. 154(b) by 0 days.

(21) Appl. No.: 18/619,153

(22) Filed: Mar. 27, 2024

(65) Prior Publication Data

US 2024/0240457 A1 Jul. 18, 2024

Related U.S. Application Data

(63) Continuation-in-part of application No. 18/485,080, filed on Oct. 11, 2023, which is a continuation-in-part (Continued)

(51) Int. Cl.
*E04B 2/76* (2006.01)
*E04B 2/78* (2006.01)

(52) U.S. Cl.
CPC ..... *E04B 2/766* (2013.01); *E04B 2/789* (2013.01)

(58) Field of Classification Search
CPC ..... E04B 2/766; E04B 2/789; E04B 2/767; E04B 2/7453; E04B 2/58; E04B 1/7608; E04B 1/7654; E04B 2/707; E04B 2001/2415; E04B 2001/2496; E04B 1/94; E04B 1/948; E04B 1/14; E04B 1/2403;

(Continued)

(56) References Cited

U.S. PATENT DOCUMENTS 5,325,651 A * 7/1994 Meyer ..... E04C 3/32 52/696
5,660,012 A * 8/1997 Knudson ..... B21D 39/034 52/656.1

(Continued)

OTHER PUBLICATIONS

Traclok Product Catalog—CLARKDIETRICH www.clarkdeitrich.com Pub. No. CD-TRAKLOC 09/20 USA.

*Primary Examiner* — Beth A Stephan

(57) ABSTRACT

The present invention describes an interlocking metal framing system where two concentric support members slide between each other to enable the support member to form a longer length without using extensions to add the additional length to the support members whether installed as vertical support members for a wall; or as horizontal support members for ceiling support members; or as floor-ceiling support members. The concentric support members have notches together to form a longer support member. The connector can be a clip connecting the two concentric support members together whether installed vertically or horizontally; or by having a longitudinal spacing-bracing member pass through the apertures connecting the perimeter notches of adjacent support members. The perimeter notches interlock the spacing-bracing member to the two concentric support members together eliminating vertical and horizontal movement between the concentric support members as well as the adjacent support members. The apertures are setback from both ends or both concentric support members allowing the additional length to be projected above or below the concentric support members.

18 Claims, 13 Drawing Sheets

Related U.S. Application Data of application No. 17/960,127, filed on Oct. 4, 2022, said application No. 17/960,127 is a continuation-in-part of application No. 17/871,964, filed on Jul. 24, 2022, now abandoned, said application No. 17/871,964 is a continuation-in-part of application No. 16/657,989, filed on Oct. 18, 2019, now abandoned, said application No. 16/657,989 is a continuation-in-part of application No. 16/525,578, filed on Jul. 30, 2019, now abandoned, said application No. 16/525,578 is a continuation-in-part of application No. 16/503,324, filed on Jul. 3, 2019, now abandoned, which is a continuation-in-part of application No. 16/449,386, filed on Jun. 22, 2019, now abandoned, which is a continuation-in-part of application No. 16/439,640, filed on Jun. 12, 2019, now abandoned, which is a continuation-in-part of application No. 16/406,289, filed on May 8, 2019, now abandoned, which is a continuation-in-part of application No. 16/396,624, filed on Apr. 26, 2019, now abandoned, which is a continuation-in-part of application No. 16/354,081, filed on Mar. 14, 2019, now abandoned, which is a continuation-in-part of application No. 16/198,831, filed on Nov. 22, 2018, now abandoned, which is a continuation-in-part of application No. 16/195,847, filed on Nov. 19, 2018, which is a continuation-in-part of application No. 15/724,137, filed on Oct. 3, 2017, now Pat. No. 10,422,136, which is a continuation-in-part of application No. 15/449,250, filed on Mar. 3, 2017, now Pat. No. 10,683,665, which is a continuation-in-part of application No. 15/430,781, filed on Feb. 13, 2017, which is a continuation-in-part of application No. 15/295,172, filed on Oct. 17, 2016, now Pat. No. 10,364,566, which is a continuation-in-part of application No. 15/090,460, filed on Apr. 4, 2016, now Pat. No. 11,060,281, which is a continuation-in-part of application No. 14/946,378, filed on Nov. 19, 2015, now Pat. No. 11,391,038, which is a continuation-in-part of application No. 13/398,243, filed on Feb. 16, 2012, now abandoned, which is a continuation-in-part of application No. 12/456,707, filed on Jun. 22, 2009, now Pat. No. 8,161,699.

(60) Provisional application No. 63/549,580, filed on Feb. 5, 2024, provisional application No. 63/469,793, filed on May 30, 2023, provisional application No. 63/453,124, filed on Mar. 19, 2023, provisional application No. 63/313,624, filed on Feb. 24, 2022, provisional application No. 63/282,152, filed on Nov. 22, 2021, provisional application No. 63/252,615, filed on Oct. 5, 2021, provisional application No. 62/900,501, filed on Sep. 14, 2019, provisional application No. 62/878,181, filed on Jul. 24, 2019, provisional application No. 62/533,092, filed on Jul. 16, 2017, provisional application No. 62/490,917, filed on Apr. 27, 2017, provisional application No. 62/485,114, filed on Apr. 13, 2017, provisional application No. 62/399,434, filed on Sep. 25, 2016, provisional application No. 62/385,932, filed on Sep. 9, 2016, provisional application No. 62/378,615, filed on Aug. 23, 2016, provisional application No. 62/360,041, filed on Jul. 8, 2016, provisional application No. 62/345,153, filed on Jun. 3, 2016, provisional application No. 62/308,520, filed on Mar. 15, 2016, provisional application No. 62/339,434, filed on May 20, 2016, provisional application No. 62/369,041, filed on Jul. 30, 2016, provisional application No. 62/298,762, filed on Feb. 23, 2016, provisional application No. 62/242,705, filed on Oct. 16, 2015, provisional application No. 62/244,135, filed on Oct. 20, 2015, provisional application No. 62/264,033, filed on Dec. 7, 2015, provisional application No. 62/274,134, filed on Dec. 31, 2015, provisional application No. 62/208,766, filed on Aug. 23, 2015, provisional application No. 62/143,097, filed on Apr. 4, 2015, provisional application No. 62/175,191, filed on Jun. 12, 2015, provisional application No. 62/170,269, filed on Jun. 3, 2015, provisional application No. 62/139,916, filed on Mar. 30, 2015, provisional application No. 62/083,276, filed on Nov. 23, 2014, provisional application No. 61/629,552, filed on Nov. 22, 2011, provisional application No. 61/628,044, filed on Oct. 24, 2011.

(58) Field of Classification Search
CPC .. E04B 2/7411; E04B 2001/2412; E04B 2/60; E04B 2/5818; E04C 3/07; E04C 3/292; E04C 2003/026; E04C 2003/0473
See application file for complete search history.

(56) References Cited

U.S. PATENT DOCUMENTS

| | | | | |
|---|---|---|---|---|
| 5,720,138 | A * | 2/1998 | Johnson | E04B 2/7457 52/656.1 |
| 5,735,100 | A | 4/1998 | Campbell | |
| 5,784,850 | A * | 7/1998 | Elderson | E04B 2/789 52/669 |
| 5,906,080 | A | 5/1999 | diGiralemo | |
| 6,374,588 | B1 | 4/2002 | Surowicki | |
| 6,701,689 | B2 * | 3/2004 | diGirolamo | E04B 2/763 52/243 |
| 6,983,569 | B1 * | 1/2006 | Rosenberg | E04B 2/7457 52/241 |
| RE39,462 | E | 1/2007 | Brady | |
| 7,223,043 | B1 | 5/2007 | Andrews | |
| 7,284,355 | B2 * | 10/2007 | Becker | E04B 2/825 52/712 |
| 7,451,573 | B2 | 11/2008 | Orszulak | |
| 7,770,348 | B2 * | 8/2010 | Tollenaar | E04B 2/767 52/696 |
| 7,823,350 | B2 * | 11/2010 | Valle | E04C 2/06 52/351 |
| 8,061,099 | B2 | 11/2011 | Andrews | |
| 8,151,526 | B2 * | 4/2012 | Klein | E04B 2/7457 52/302.1 |
| 8,245,466 | B2 * | 8/2012 | Wright | E04B 2/7457 52/579 |
| 8,250,822 | B2 * | 8/2012 | O'Connor | F16B 2/248 24/546 |
| 8,281,552 | B2 * | 10/2012 | Pilz | E04C 3/09 52/846 |
| 8,590,257 | B2 * | 11/2013 | Yurko, Sr. | E04B 2/768 52/656.1 |
| 8,615,959 | B2 * | 12/2013 | Ferguson | E04B 2/767 52/653.1 |
| 8,733,044 | B2 * | 5/2014 | Dollerup | E04B 2/765 52/290 |
| 8,813,456 | B2 | 8/2014 | Lin | |
| 9,016,024 | B1 | 4/2015 | Daudet | |
| 9,127,456 | B2 * | 9/2015 | Dollerup | E04C 3/00 |
| 9,909,298 | B2 | 3/2018 | Pilz | |
| 2002/0002803 | A1 * | 1/2002 | Atkin | E04B 2/7453 52/844 |

(56) References Cited

U.S. PATENT DOCUMENTS

| | | | | |
|---|---|---|---|---|
| 2003/0106280 | A1* | 6/2003 | diGirolamo | E04B 2/7457 52/656.1 |
| 2008/0006002 | A1* | 1/2008 | Strickland | E04C 3/07 29/897 |
| 2019/0249411 | A1* | 8/2019 | LeBlang | E04B 2/7457 |

* cited by examiner

ADJUSTABLE METAL FRAMING SYSTEM AND CONNECTON

CROSS REFERENCED TO RELATED APPLICATIONS

This application is a continuous-in-part pending application U.S. Ser. No. 12/456,707, filed on Jun. 22, 2009, now U.S. Pat. No. 8,161,699 and this application claims priority to the following:

- continuous-in-part pending application U.S. Ser. No. 18/619,153 this application filed Mar. 27, 2024 which claims benefit to;
- provisional application U.S. 63/549,580 filed Feb. 5, 2024 and,
- provisional application U.S. 63/469,793 filed May 30, 2023 and,
- continuous-in-part pending application U.S. Ser. No. 18/495,080 filed Oct. 11, 2024 which claims benefit to;
- provisional application U.S. 63/453,124 filed Mar. 19, 2023 and,
- provisional application U.S. 63/469,793 filed May 30, 2023 and,
- continuous-in-part pending application U.S. Ser. No. 17/960,127 filed Oct. 4, 2022 which claims benefit to:
- provisional application U.S. 63/313,624 filed Feb. 24, 2022 and,
- provisional application US 63/282,152 filed Nov. 22, 2021 and,
- provisional application U.S. 63/252,615 filed Oct. 5, 2021 and,
- continuous-in-part pending application U.S. Ser. No. 17/871,964 filed Jul. 24, 2022 which claims benefit to;
- provisional application U.S. 63/313,624 filed Feb. 24, 2022 and,
- provisional application US 63/282,152 filed Nov. 22, 2021 and,
- provisional application U.S. 63/252,615 filed Oct. 5, 2021 and,
- continuous-in-part pending application U.S. Ser. No. 16/657,989 filed Nov. 18, 2019 and;
- provisional application U.S. 63/900,501 filed Sep. 14, 2019 and,
- provisional application US 63/898,181 filed Sep. 10, 2019 and,
- continuous-in-part pending application U.S. Ser. No. 16/525,578 filed Jul. 29, 2019, now abandon and;
- continuous-in-part pending application U.S. Ser. No. 16/503,324 filed Jul. 3, 2019, now abandon and;
- continuous-in-part pending application U.S. Ser. No. 16/449,386 filed Jun. 22, 2019, now abandon and;
- continuous-in-part pending application U.S. Ser. No. 16/439,640 filed Jun. 12, 2019, now abandon and;
- continuous-in-part pending application U.S. Ser. No. 16/406,289 filed May 8, 2019, now abandon and;
- continuous-in-part pending application U.S. Ser. No. 16/396,624 filed Apr. 26, 2019, now abandon and;
- continuous-in-part pending application U.S. Ser. No. 16/354,081 filed Mar. 14, 2019, now abandon and;
- continuous-in-part pending application U.S. Ser. No. 16/198,831 filed Nov. 22, 2018, now abandon and;
- continuous-in-part pending application U.S. Ser. No. 16/195,847 filed Nov. 19, 2018, now abandon and;
- continuation-in-part pending application U.S. Ser. No. 15/724,137 filed Nov. 3, 2017 now U.S. Pat. No. 10,442,136 issued Sep. 24, 2019 which claims benefit to;

- provisional application U.S. 62/533,092 filed Jul. 16, 2017 and,
- provisional application U.S. 62/490,917 filed Apr. 27, 2017 and,
- provisional application US 62/485,114 filed Apr. 13, 2017 and,
- continuous-in-part pending application U.S. Ser. No. 15/449,250 filed Mar. 3, 2017 now U.S. Pat. No. 10,683,665 issued Jun. 6, 2016 which claims benefit to;
- provisional application U.S. 62/399,434 filed Sep. 25, 2016 and,
- provisional application U.S. 62/385,932 filed Sep. 9, 2016 and,
- provisional application U.S. 62/378,615 filed Aug. 23, 2016 and,
- provisional application US 62/345,153 filed Jun. 3, 2016 and,
- continuous-in-part pending application U.S. Ser. No. 15/430,781 filed Feb. 13, 2017 which claims benefit to;
- provisional application U.S. 62/385,932 filed Sep. 9, 2016 and,
- provisional application U.S. 62/378,615 filed Aug. 23, 2016 and,
- provisional application U.S. 62/369,041 filed Jul. 30, 2016 and,
- provisional application U.S. 62/308,520 filed Mar. 15, 2016 and,
- continuation-in-part pending application U.S. Ser. No. 15/295,172 dated Oct. 17, 2016 now U.S. Pat. No. 10,364,566 issued Jul. 30, 2019 which claims benefit to; which claims benefit to;
- provisional application U.S. 62/378,615 filed Aug. 23, 2016 and,
- provisional application U.S. 62/369,041 filed Jul. 30, 2016 and,
- provisional application US 62/345,153 filed Jun. 3, 2016 and,
- provisional application U.S. 62/274,134 filed Dec. 31, 2015 and,
- provisional application U.S. 62/264,033 filed Dec. 7, 2015 and,
- continuous-in-part of pending application U.S. Ser. No. 15/090,460 filed Nov. 19, 2015 now U.S. Pat. No. 10,060,281 issued Jul. 13, 2021 which claims benefit to; which claims benefit to;
- provisional application U.S. 62/242,705 filed Nov. 16, 2015 and,
- provisional application U.S. 62/208,766 filed Aug. 23, 2015 and,
- provisional application US 62/175,191 filed Jun. 12, 2015 and,
- provisional application U.S. 62/170,269 filed Jun. 3, 2015 and,
- provisional application U.S. 62/143,097 filed Apr. 4, 2015 and,
- continuous-in-part of pending application U.S. Ser. No. 14/946,378 filed Mar. 3, 2015 now U.S. Pat. No. 11,391,038 issued Jul. 19, 2022 which claims benefit to; which claims benefit to;
- provisional application US 62/175,191 filed on Jun. 12, 2015, and,
- provisional application U.S. 62/170,269 filed Jun. 15, 2015 and,
- provisional application U.S. 62/139,916 filed Mar. 30, 2015 and,
- provisional application U.S. 62/083,276 filed Nov. 23, 2014 and, Application Ser. No. 13/398,243, filed Feb. 16, 2012, and claims benefit of provisional application No. 62/170,269 filed Jun. 3, 2015 and, provisional application No. 62/175,191, filed Jun. 12, 2015 and, provisional Application No. 62/139,916 filed Mar. 30, 2015 and, provisional application No. 62/083,276 filed Nov. 23, 2014, application Ser. No. 13/398,243 (now abandoned) claims benefit of Provisional application No. 61/629,552, filed Nov. 22, 2011 and, Provisional application No. 61/628,044, filed Oct. 24, 2011 and, application Ser. No. 13/398,243 is a continuation-in-part of application Ser. No. 12/456,707 now U.S. Pat. No. 8,161,699.

The disclosures of application Ser. No. 13/398,243 filed Feb. 16, 2012, Provisional application No. 61/628,044 filed Oct. 24, 2011, Provisional application No. 61/629,442 filed Nov. 18, 2011, Application Ser. No. 12/231,875, filed Sep. 8, 2008 and application Ser. No. 12/456,707 filed Jun. 22, 2009 now U.S. Pat. No. 8,161,699, are hereby incorporated by reference, including all drawings and all the specifications.

FEDERALLY SPONSORED RESEARCH OR DEVELOPMENT

Not applicable

PARTIES OR JOINT RESEARCH

Not applicable

FIELD OF THE INVENTION

The present invention describes an interlocking metal framing system where two concentric support members slide between each other to enable the support member to form a longer length without using extensions to add the additional length to the support members. The concentric support members have apertures with perimeter notches for the connector spacing-bracing member to interlock the perimeter notches together to form a longer support member. The connector can be a clip connecting the two concentric support members together whether installed vertically or horizontally; or by having a longitudinal spacing-bracing member pass through the apertures connecting the hole notches of adjacent support members. The hole notches interlock the spacing-bracing member to the two concentric support members together eliminating vertical and horizontal movement between the concentric support members as well as the adjacent support members. The apertures are setback from both ends or both concentric support members allowing the additional length to be projected above or below the concentric support members. The top end and the bottom end to the concentric support members have two L-shape gaps. The floor base channel or ceiling base channel are mounted to the floor and ceiling with each having lips extending from web and flanges with the lips extending into the short leg of the L-shaped notch. The lips have lip notches to keep the bottom or top ends of the concentric support members from moving vertically and or horizontally, the lip notches are cut into the distal edge of the lip that connect to the hole notches at the aperture.

BACKGROUND OF THE INVENTION

Light gauge metal framing consists of vertical and horizontal framing members that are screwed or welded together to form a structural frame for walls, floors, and ceiling framing for buildings. The vertical support members are typically a C-shape configuration that connect to a floor base channel or ceiling base channel by placing the support member into the floor base the flanges until aligned within the base channel, fasteners are then installed at the flanges of the floor base plate into the flanges of the support member. In addition, holes are installed into the web of the support members and horizontal bracing members connect the support members together. Early assembly connections had horizontal bracing members supported loosely within the holes, later adding angles to the support member to then connect fasteners to the angles and the horizontal bracing members. Over the years the properties of the metal for structural framing members have changed where the exterior surface of the metal is more abrasive allowing the connection between the horizontal bracing members and the vertical structural framing members to fit temporarily together.

Metal framing has progressed from interior metal framing supports to metal framing components having structural properties for load bearing wall systems and panelized wall systems with the exterior façade being finished and craned into position at and exterior wall. On the other hand, there has been no means to interlock the panelized wall sections to the building structure in a fast and efficient means.

When constructing buildings, it is easy to be off and inch here to a meter there, that then requires cutting or adding to existing support members in a very costly and effective method to construct metal framing. In addition, concrete structures are difficult because of the uneven surfaces. In high rise buildings high partition walls are difficult to install as well as deliver a long framing member up 30 stories. It is much easier to deliver materials up an elevator rather than requiring a crane to lift the materials up thirty stories which is expensive and time-consuming waiting for crane availability.

DESCRIPTION OF PRIOR ART

Typically metal framing members are connected by screws or by welding the individual components together. The screws fasteners are used for light gauge framing but are also used for the heavier gauge metal. The bearing walls using metal framing are a heavier gauge metal and the components are connected by fasteners but are also crimped or welded together or threaded bolts with washer are used for heavy gauge metal. Some horizontal bracing members have used rivets or crimping two members together. Prior art has made some improvements to restrict horizontal movement between metal framing members, however, there has been no attempt to eliminate vertical movement without fasteners.

In addition, vertical and horizontal wall framing members have not been fastened together without using screws or welding, which have not been compatible to just click to twist together without the mechanical means of screws or welding. The present invention allows the horizontal and vertical framing members to just mechanically connect two components together. Many variations of a floor base channel have been developed using various notches, however none of the variations have eliminated the flanges for the floor channel base as the flanges of the base channel is used as the connecting means to secure the support member to the base channel. In addition, early attempts of securing the vertical and horizontal members together do not use an aperture in the web at the top and bottom of the support member nor in the service aperture in the middle of the web.

In fact, this application shows notches within the service holes and the connection holes at the top and bottom of the support member that include notches. The lips with its notches in the base plate fit into the L-shaped notches at the vertical support member.

The patent by Andrews, Wm U.S. Pat. No. 7,223,043 issued May 29, 2007, U.S. Pat. No. 8,074,416 issue Dec. 13, 2011 changes the shape of the U-shaped floor framing member having V-shaped bulges at the floor track and support member extending inward toward the flanges of the support member that has a recess in the flanges to accommodate the V-shaped protrusion. The patent attempts to connect the two members without using fasteners, the patent prevents vertical movement of the support member with no means of preventing horizontal movement. Another patent by Andrews, Wm U.S. Pat. No. 8,061,099 issued Nov. 22, 2011 where a telescoping support member is extended above a stationary support member and the telescoping support member moves when the ceiling above has movement for excessive floor loads and the telescoping support member has concave flanges so drywall fasteners will not connect to the telescoping support member.

SUMMARY OF THE INVENTION

The concentric support members have an inner concentric support member and an outer concentric support member where the inner support member slides within the C-shape configuration of the concentric outer support member. The inner concentric support member overlaps the outer concentric support member so the apertures in the web of the concentric support members can overlap each other, and where each aperture has perimeter notches. The support member can be adjusted so the perimeter notches in the aperture of the inner and the outer concentric support members can be aligned. The apertures have at least three perimeter notches to increase or decrease the inner and outer support member length of the two support members when joined together by changing the alignment of the perimeter notches in the inner and outer concentric support member alignments. The perimeter notches act like fasteners to secure the desired length settings between the concentric support members. A spacing-bracing member is inserted into the apertures and engaging the desired perimeter notches settings in order to become logged into the side edges of the perimeter notches, thereby securing the support member to the desired length. The aperture connection can be a U-clip that overlaps the perimeter notches in both support members, against the webs of both support members; or the aperture connection can be a short clip shaped as a spacing-bracing member; or a spacing-bracing member that connects two adjacent concentric support member apertures by using the spacing-bracing member to connect the two adjacent concentric support members. The U-clip connection can be installed as described above, or a short sb-clip (spacing-bracing clip) can be installed having the same configuration as the spacing-bracing member. The short sb-clip or U-clip can be installed first at both concentric support members, then the spacing-bracing member can be installed connecting both concentric support members. Depending on the difficulty of the installation the spacing-bracing members the continuous aperture between the inner and outer support member could be installed without using either clip for connection or the continuous spacing-bracing member could be installed that can connect adjacent support members. The drawings also show the U-clip having a receiver end, which is a flange extension of the U-shape clip that forms a W-shape clip. The W-shape clip has the receiver end on both sides allowing for a spacing-bracing member having a tongue end at both ends to fit into the receiver ends of a W-shape clip.

Depending on the end configuration of the support members, the top end of the inner concentric support member and the bottom end of the outer concentric support member can have two L-shaped gaps in the apertures at the inner and outer concentric support ends. The two L-shaped gaps connect to a hat-channel shaped ceiling and floor mounted spacer brace. The base of the hat-channel shape is a web that is mounted to the floor or ceiling; and the brim or lips of the hat-channel shape are installed into the L-shaped gaps. The L-shaped gaps can be located at both ends of the inner and outer concentric support members where the extension may occur above or below the outer concentric support.

The perimeter notches at the apertures should have the side edges of the notches angled allowing the lips extending from the spacing-bracing member to be pressured to abut the angle notch edges of the perimeter notches at the aperture, thereby increasing friction and creating a tighter connection. The lips of the spacing-bracing members should have lip notches that are angled for the perimeter side walls to abut the angular side edges of the lip notch and the lip notches should be offset to each other allowing the angled side edges of the lip notches to engage the sloped side edges of the perimeter notches. The lip ends with its notches allows the notches of both the metal support member and the spacing-bracing members to engage and interlock between each other thereby securing the two framing members together from vertical and horizontal movement between each other. The notches interlock between each other in such a way that the notches function as screws as the fastening method for connecting metal framing therefore eliminating a screwdriver and the man hours to install screws rather than just snapping notches together.

The spacing-bracing clip member has a U-shape configuration where the web of the configuration fits into the perimeter notches and, the flanges of the U-shape configuration abuts the web of both the inner and outer concentric support members. The U-shape configuration of the spacing-bracing clip can have a short segment of the spacing-bracing member where the lip fits into the perimeter notches and where the lip has lip notches that engage the perimeter notches. When the perimeter notches are deeper, the flange with notches or the hat-shape configuration with notches can engage the larger perimeter side notches as well as the lips with lip notches.

Another embodiment is the present invention describes a metal framing system having metal support members connect to horizontal spacing-bracing members through the intermediate access holes in the web of metal support members, through the apertures of concentric support members and at the top end and bottom end of the metal support members. The horizontal spacing-bracing members intersect and connect the metal support members by having perimeter side notches that are vertical notches that indent the perimeter side edges of the aperture in the support member and the spacing-bracing member to overhang the aperture letting the notches make the connection. The perimeter notches in the aperture should be angled for the lips to engage the side edges of the perimeter notches and to prevent and eliminate vertical movement. The spacing-bracing member has notches in the lips or flange extensions having notched ends that engage the aperture side edges with the spacing-bracing member overhangs the aperture in the support member. The metal support member has two L-shaped gaps in the web that correspond to the two L-shaped flange lip extensions at the ceiling and floor horizontal spacing-bracing members for the L-shaped flange-lip extensions with the lip notches engage the gap notches.

The center reverse lip spacing-bracing member at the base plate has the same configuration as a horizontal spacing-bracing member installed in the apertures of the metal support members connecting adjacent support members. The horizontal spacing member can vary in shape and consist of a web with extending flanges from the web and additional flanges or lips extending from the flanges with flange or lip notches that engage the aperture side edges. The lip notches or flange notches are angled and or offset to the lip of flange notches on the opposing flange from the web. When bulge notches are used the bulge notches can be cut at a slight angle allowing the side edge of the slide gap 45*s* to engage the side edges of the bulge notch and the bulge notch on the first flange can be offset to the bulge notch on the second flange if the bulge notch is required to have friction to reduce movement. On the other hand, the bulge notches would be in alignment with the slide gap side edge at the ends of the support member.

Another aspect of the invention allows the structural wall system to be used as a load-bearing wall system where the inner support member has a rigid connection between the inner and outer support member; or as a non-load-bearing wall system where the floor and ceiling mounted horizontal spacing-bracing member can be installed as a two-step process, that is the center inner U-shaped bracing member is installed first and fastened to the floor and ceiling. The outside irregular shaped members are installed over an array of the support members with or without the exterior rigid boards like drywall are installed at the flanges of the support members forming a rigid framing panel. The rigid framing panel is then installed over the center inner U-shaped bracing member, so the lips of the center inner U-shaped bracing member engage the L-shaped notches in the web of the support member interlocking the two members together.

Another aspect of the invention where the two concentric support members can be installed with a horizontal orientation rather than a vertical orientation. When installing a drywall ceiling, the horizontal support members are not referred to as studs, but a floor or ceiling joists. A drywall solution can be installed for appearance or for a fire resistance barrier and therefore the weight requires a strong support member to carry the load of drywall. So, when installing the support members, ceiling hangers are installed at the connector member apertures of the support member and the perimeter notches in the apertures allow for adjustments to occur when intersecting the wall support members that at the construction site. The horizontal support members are the lateral bracing requirements for a drywall framed ceiling.

Another aspect of the invention is the connection of the horizontal connector member can be installed back-to-back where the web of a first horizontal connector is attached to a second horizontal connector at the web, therefore the lip notches at the top end of a lower support member is connected to the first horizontal connector and the upper support member connects to the second horizontal connector. When this occurs the upper and lower support members do not overlap between the outer support member and the inner support member. With no overlapping additional bracing between the upper and lower support member will be required to reduce buckling.

BRIEF DESCRIPTION OF THE DRAWINGS

FIG. 16 shows the hook receiver as shown in FIG. 15 but also shows the tongue end with the notched tab that connects to the notches at the hook receiver.

Figure 22:
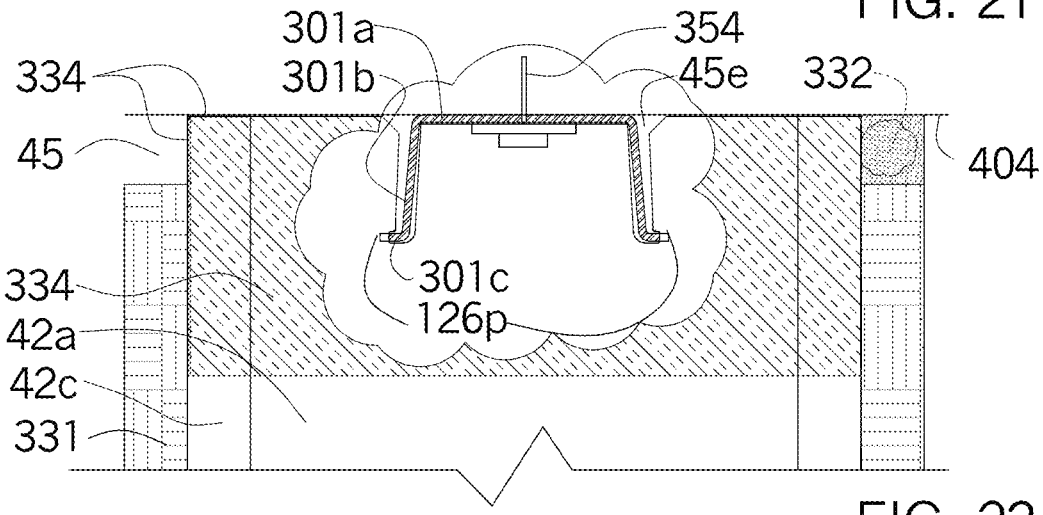
Figure 23:
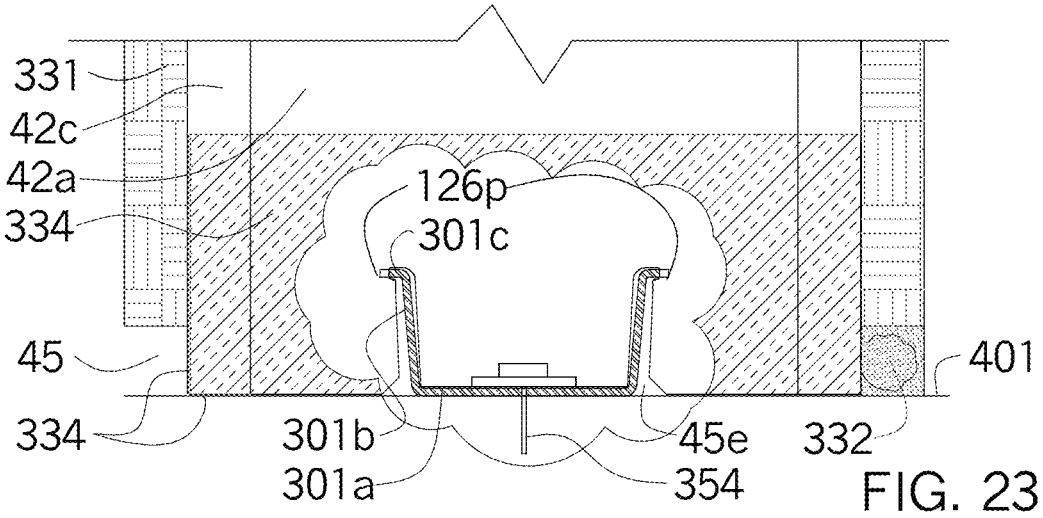

No additional FIG's are shown, however when the profile of FIG. 23 is installed over the profile of FIG. 22 forming a back-to-back connection of the connector members as another method to connect the L-shape gap at an inner support member 42*i* extension to the L-shaped gap at an outer support member 42*o*. The same connection can be used for the ceiling construction when the connector member is braced at the ceiling structure on the building construction.

No additional FIG's are shown, however FIG. 22 and FIG. 23 or FIG. 25 and FIG. 26 could have the web of the reverse lip spacer channel or web of the base channel able to connect to a wall structure (masonry or concrete wall) or a metal framed wall structure using fasteners into the wall construction to form a metal framed ceiling construction using the inner and the outer concentric support members as the horizontal framing members and the appropriate support hangers from the building ceiling structural system.

DESCRIPTION

Figure 1:
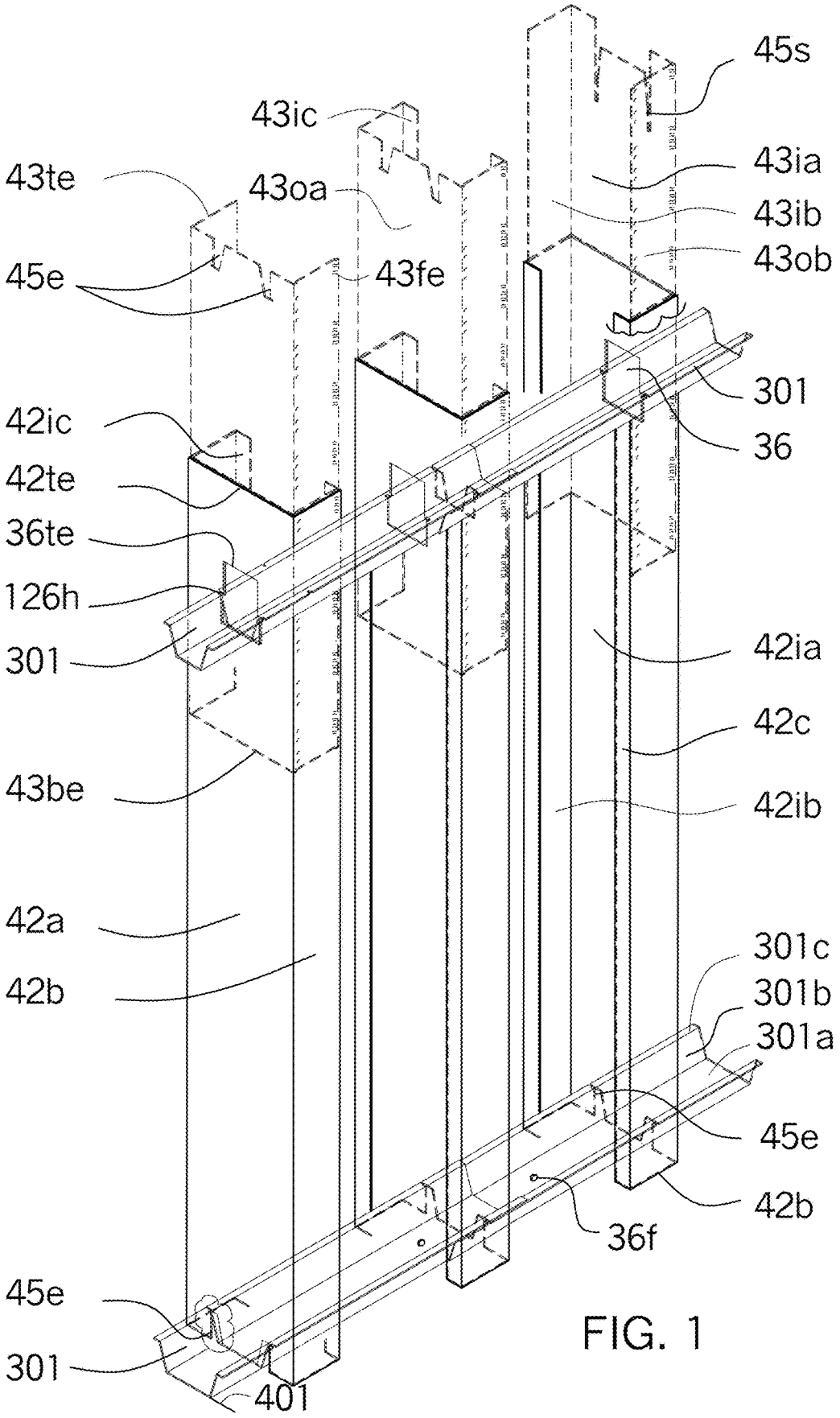
FIG. 1 shows an array of two concentric support members having an inner U-shape support member being extended within the interior surface planes of a C-shape support member with both the U-shape and C-shape support members each having an aperture cut into the web of each member for a horizontal spacing bracing member connecting the apertures and connected with perimeter notches at the aperture and a reverse lip spacer brace with lip notches at the floor along with the perimeter notches at the inner support member at the top end.
Figure 2:
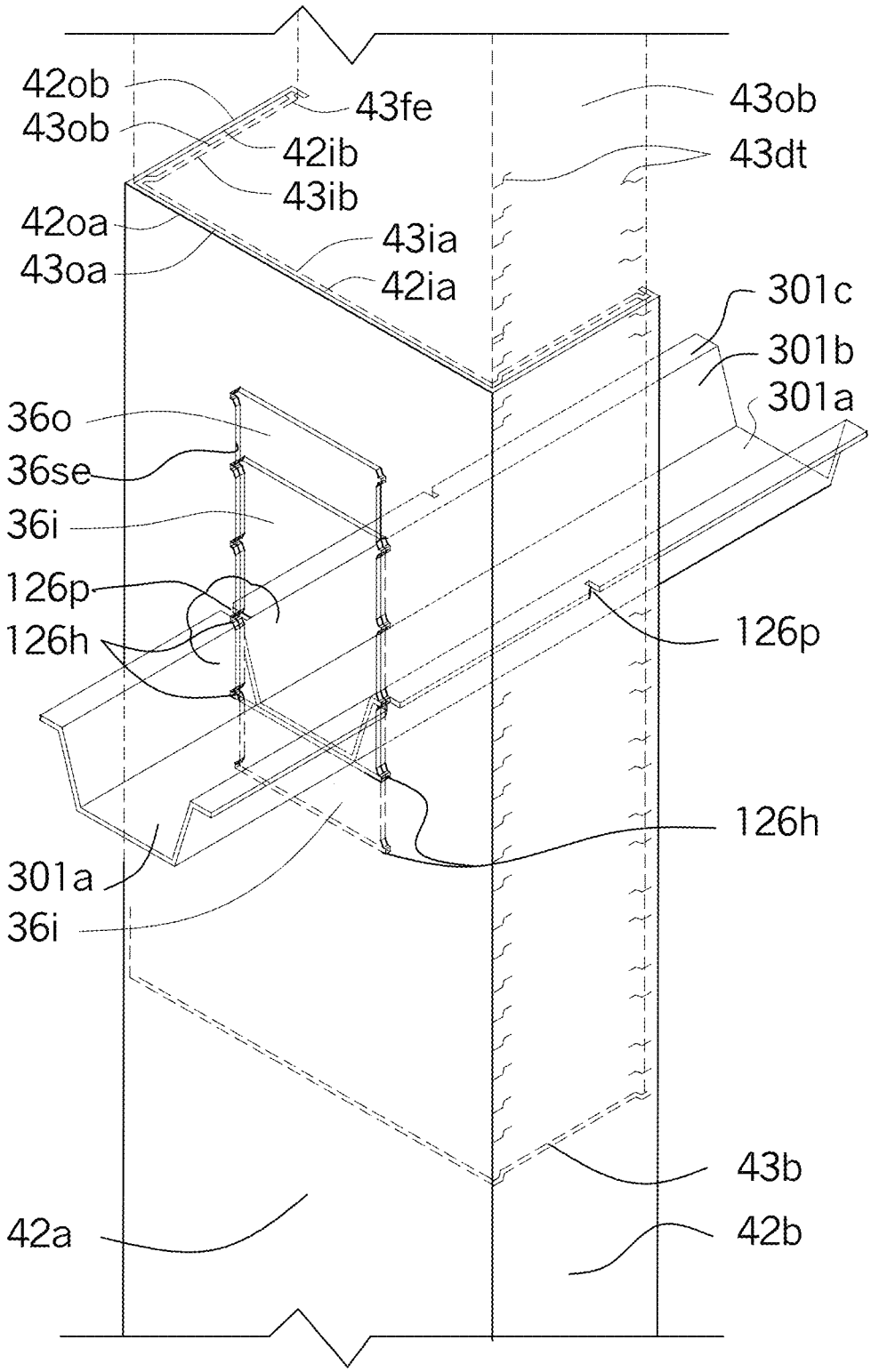
FIG. 2 shows two apertures at the inner and outer concentric support members with the reverse lip spacer brace extending through the perimeter notches.

FIG. 1 and FIG. 2 shows an isometric drawing of a reverse lip spacer brace 301 intersecting two concentric overlapping support members where an outside support member 42 wraps around an inside support member 43 shown as a dash image in FIG. 1 and in FIG. 2. A reverse lip spacer brace 301 is connected to a floor 401 at the first end of an outside support member 42 and another reverse lip spacer brace 301 is connected to a ceiling 404 at the second end of and inside support member 43 as shown in some later FIG's. The outside support member 42*o* has a C-shape configuration having a web 42 connected to a first flange 42*b* with an attached lip 42*c* with each member having an inside plane 42*i*, 42*ib*, 42*ic* and an outside plane 42*oa*, 42*ob*, 42*oc* and the web 42*a* connected to an opposing second flange 42*b* opposite said first flange 42*b* with an attached lip 42*c*. The inside support member 43 has a U-shape configuration with a web 43*a* connected to a first flange 43*b* with each member having an inside plane 43*ia*, 43*ib*, and an outside plane 430*a*, 43*ob*. The inside support member 43 has a first corner 43*cr* and an opposing second flange 43*b* forming a second corner 43*cr*. The first and second flanges 43*b* are shown setback from the corners forming an indentation 43*dt* from the first corner 43*cr* and the second corner 43*cr* with the distal edge of the first and second flange 43*b* having a flare edge 43*fe* at the distal edge of the first and second flange 43*b*. The indentation 43*dt* allows the first and second corners 43*cr* to abut and slide vertically within the inside flange plane 42*ib* at the first and second flange 42*b* of the outside support member 42 as well as a flare edge 43*fe* at the distal edges of the first and second flange 43*b* of the inside support member 43. FIG. 1 and FIG. 2 shows an outside support member 42 having an outside aperture 36*o* and an inside support member 43 having an inside aperture 36*i*. The outside support member 42 has an inside plane at the aperture 36*i* and an outside plane at the aperture 36*o*. The inside support member 43 has an inside plane at the aperture 36*i* and an outside plane at the aperture where the outside support member 42 overlaps the inside support member 43. The overlapping outside support member 42 with the inside support member 43 shows the aperture 36 at the outside support member 42 and aperture 36 at the inside support member 43. The second end at the outside support member 42 shown as the outside web 42*oa* overlaps the first end of the bottom edge 43*be* or the inside web 43*ia* of the inside support member 43.

At the first end of the outside support member 42 and the second end of the inside support member 43 both show the distal ends each having a pair of L-shape notch 126*e*, sometimes referred to a first L-shaped gap 45*e* and a second L-shaped gap 45*e*, where the distal end is cut to form a long leg with the short leg is an extension or a hole notch 126*h* from the long leg connecting the short leg of the first and the second L-shape gaps 45*e* extending toward the first and the second outer flanges 42*ob* of both the outer support member 42 and the inner support member 43, also see FIGS. 17-26.

A reverse lip spacer brace 301 with a longitudinal web 301*a* having an extending first wall 301*b* from the longitudinal web 301*a* and a second wall 301*b* from the opposing side of the web 301*a*. The first wall 301*b* and the second wall 301*b* have an extending wall 301*b* also referred to as a first lip 301*c* with a first lip notch 126*p* and a second lip 301*c* with a second lip notch 126*p*. extended side walls 301*bb* have an indentation cut into the longitudinal side edge of the extended side wall 301*bb* forming a side wall notch 126*p*. The extended side wall 301*bb* has also been referred to as a first lip 301*c* attached to the first side wall 301*b* and a second lip 301*c* attached to the second side wall 301*b* with both first lip 301*c* and the second lip 301*c* have lip notches 126*p*. The first lip 301*c* extends into the first L-shaped gap 45*e* and the second lip 301*c* extends into the second L-shaped gap 45*e* as also shown in FIG. 23. The second end of the inner support member 43 shows the third L-shaped gap 45*e* and fourth L-shaped gap 45*e* shows the first lip 301*c* with a first lip notch 126*p* and the second lip 301*c* with a second lip notch 126*p* engaging the hole notch 126*h* of the L-shaped gap 45*e* and shown in FIGS. 19 & 20. The reverse lip spacer brace 301 is shown spanning between adjacent support members 42. The reverse lip spacer brace 301 with the lip notches 126*p* engages the side edges of the L-shape gap 45*e* at the floor and becomes secured into the L-shape gaps 45*e* when the lip notches 126*p* engages the back edge of the L-shaped gap 45*e*. In FIG. 1 and in an enlarged view in FIG. 2 shows the L-shaped gaps 45*e* have having tapered side walls so the first and second side walls will bend as the lip 301*c* and lip notch 126*p* slide into the L-shape gap 45*e*. The L-shape gaps 45*e* functions as a hole notch 126*h* at the floor 401 and the ceiling 404 shown in FIGS. 21-26. The L-shape gap 45*e* keeps the lip notch 126*p* secured for vertical movement and the lip notch 126*p* keeps the reverse lip spacer brace 301 from horizontal movement. In addition, two L-shaped gaps 45*e* or two slide gaps 42*s* can be shown at the top end of the inner concentric support member 43 at the top end of the web 42*a*. The middle configuration shows a concentric outside support member 42 overlapping a concentric inner support member 43 the outside concentric support member 42 having apertures 36 to connect a reverse lip spacer brace 301 as shown in FIG. 2. An enlarged view is shown in FIG. 2 show the flange 42*b* and the inside web 42*i* of the outside spacing member 42 adjacent to the inside web 43*oa* of the inside spacing member 43 with a flange indentation 43*dt*. The flanges 43*ib* are indented leaving the corner edges 43*cr* and at the flare edge 43*fe* able to protrude slightly for the inner support member corner edges 43*cr* able to slide against the inner plane of the flange 42*ib* of the outside support member 42 easier to slide between the two surfaces reducing friction between the two members.

FIG. 2 shows an enlargement of the reverse lip spacer brace 301 in FIG. 1 passing through the outer and inner apertures 36*o* & 36*i* at the overlapping outer support member 42 and the inner support member 43 shown in ghost. At the top edge of the outer support member 42 shows the outer web 42*oa* and the inner web 42*ia*. The outer support member 42 with the inner web 42*ia* abuts the inner support member 43 at the outer web 430*a*. The outer aperture 36*o* is shown slightly above the inner aperture 36*i*. Even though the two apertures are not vertically in alignment, however the hole side edges 36*se* are aligned as well as the hole notches 126*h* at both the inner and outer support members 42 & 43. There are several hole notches allowing the ends of the inner and outer support members to be adjusted to the exact height between the first horizontal spacing member at the floor and the second horizontal spacing member at the ceiling as shown in FIG. 1. The horizontal reverse lip spacer brace can be a channel connecting several support members or short individual horizontal reverse lip spacer brace. The first and second lip notches 126*p* engage the hole notches 126*h* in the adjacent support member where the lip notches 126*p* are setback from the first end and the second end leaving an overhang of the reverse lip spacer brace from the aperture 36*ai* & 36*oi*.

Figure 3:
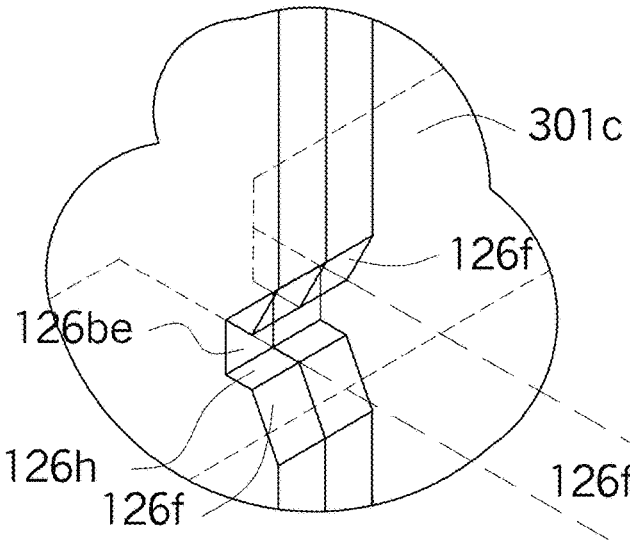
FIG. 3 shows an enlargement of two perimeter notches at the side edges of the aperture and FIG. 4 shows the lip with the lip notch that extends into the perimeter notches of FIG. 3.
Figure 4:
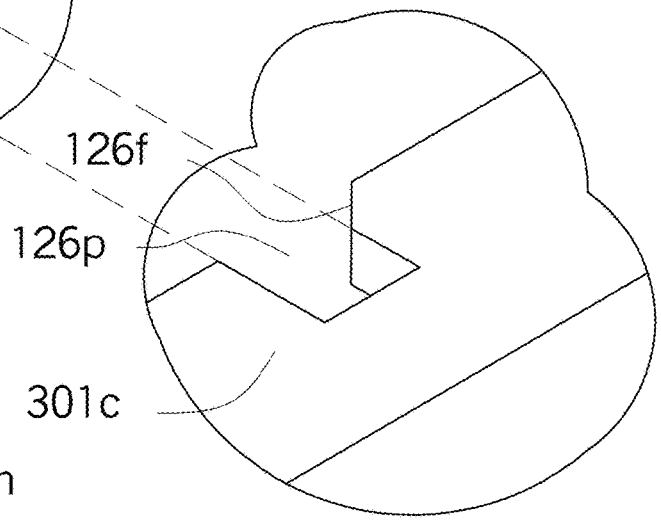

FIG. 3 through FIG. 6 shows an isometric drawing of an intersecting reverse lip spacer brace 301 shown in ghost intersecting the web 42*oa* & 42*ia* of the outer and inner support members. FIG. 3 shows the perimeter notch 126*h* aligned with the perimeter notch 126*h* in both the outer and inner support members 42 & 43. The perimeter notch 126*h* is shown having a back edge 126*be* with a horizontal side and a slope top side edge with the entrance having flare side edge 126*f*. The flare side edge allows the spacer brace to be inserted into the perimeter notch 126*h* from the bottom or top end of the perimeter notch 126*h*. The sloped side edge 126*de* allows the horizontal bracing member or horizontal clip 308 to engage the side edge of a clip or spacer brace forced by pressuring the side edges of a spacing-bracing member or clip to engage the sloped side edge of the perimeter notch 126*h*. The flare edge 126*f* allows the lip to slide horizontally to engage the perimeter notches.

Figure 5:
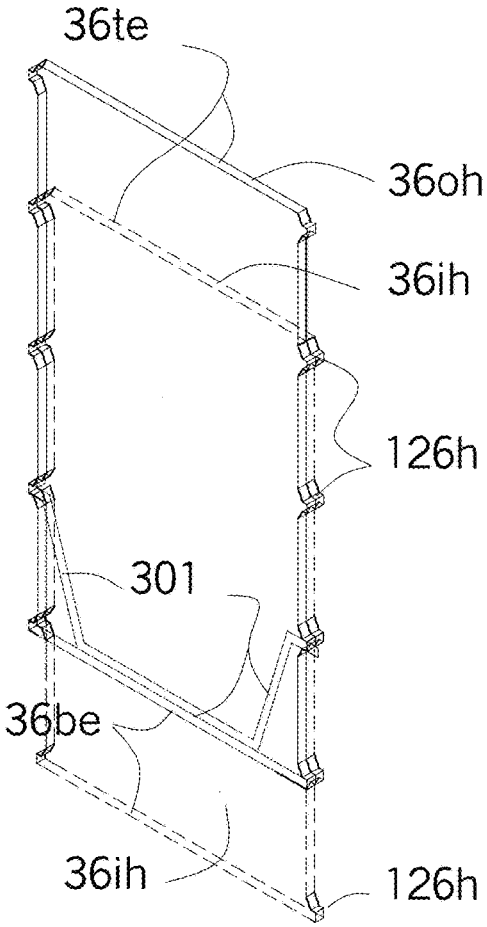
FIG. 5 shows the aperture of the inner concentric support member and the aperture of the outer support member with the perimeter notches aligned between the two members.

FIG. 5 shows an enlargement to the outside aperture 36*o* at the outside concentric support member 42 and the inside aperture 36*i* of an inside concentric inside support member 43. The two apertures 36 are not in alignment but the perimeter notches 126*h* are in alignment allowing a horizontal spacing-bracing member (not shown) to interlock the perimeter notches 126*h* to engage the side edges of the clip notch 126*w* or the lip 301*c* and or lip notches 126*p* to engage the perimeter notches 126*h*.

Figure 6:
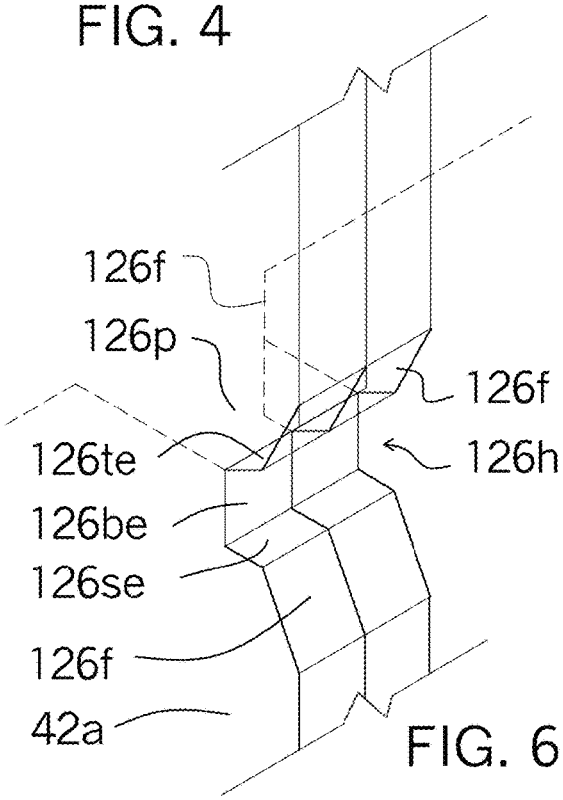
FIG. 6 shows and enlargement of a U-shape clip that is installed at the bottom edge of the aperture used to connect two concentric support members together before installing a spacing-bracing member connecting additional adjacent concentric support members.

FIG. 6 is an enlargement of FIG. 3 showing the concentric inner and outer support members having the inner web 42*ia* and the outer web 42*oa* abut each other as shown in FIGS. 1 & 2. FIG. 6 shows the sloped top edge 126*te* of the perimeter notch 126*h*. The perimeter notch 126*h* is shown having a shallow depth, however a deeper sloped top edge 126*te* is better as the angle side edge has a better chance of forming a tighter connection, because the flange 301*b* of the spacing-bracing spacer brace 301 can bend more thereby allowing the lip notch 126*p* engage the perimeter hole notch 126*h* creating a tighter connection. The tighter the connection the less chance of having the two members become disengaged. The sloped flare edge 126*f* is shown at the top and bottom entrance to the perimeter notch 126*h*.

Figure 7:
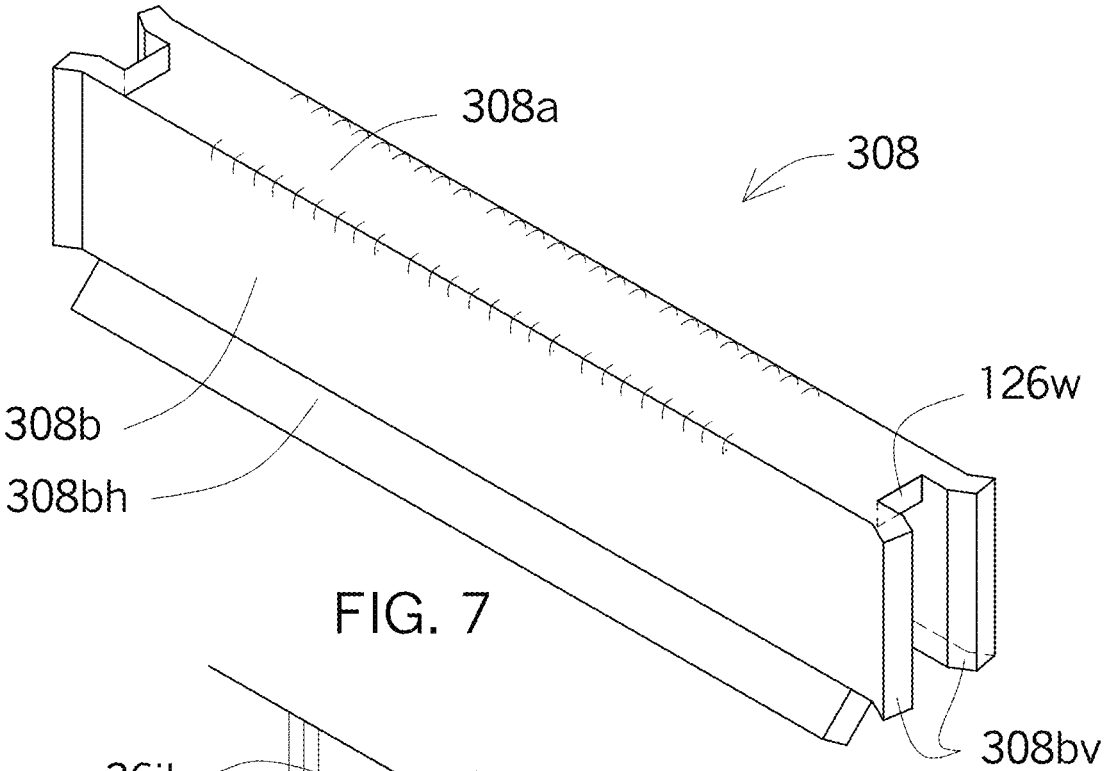
FIG. 7 shows an isometric drawing of the U-shape clip installed in the perimeter notches of the two concentric support members.
Figure 8:
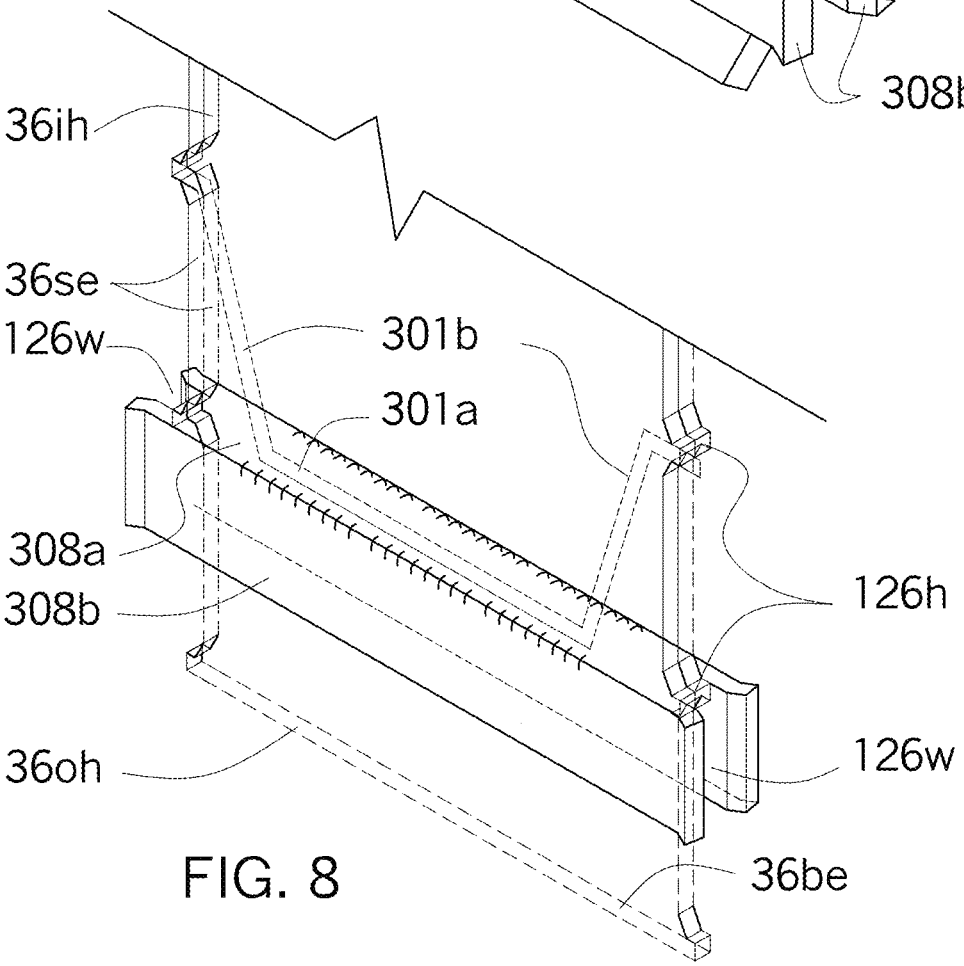
FIG. 8 shows an isometric drawing of the U-shape clip installed over the bottom edge of two adjacent apertures of an outer and inner support members with the second support member shown as a dashed image; the spacing-bracing member is installed over the U-shape clip to connect adjacent concentric support members together as well an adjacent support members.

FIG. 7 & FIG. 8 show a U-shaped clip 308 that is used as a quick connection at the outside aperture 36*o* and inside aperture 36*i* at the overlapping outside support member 42 and the inside support member 43. The U-shaped clip 308 has having a web 308*a* that extends the width of the opening at the perimeter hole 36*h* from the first perimeter side edge 36*se* to the second perimeter side edge 36*se*.

FIG. 8 shows the U-shaped clip 308 installed in the hole notches 126*h* at the perimeter side edges of the aperture 36 at the perimeters of the concentric inner and outer support member 43 & 42. The U-shaped clip 308 is also resting on the outside aperture bottom edge 36*obe* of the outer concentric support member. The reverse lip spacer brace 301 is shown in ghost as the web 301*a* is resting on the web 308*a* of the U-shaped clip 308.

The U-shaped clip 308 is used when the installer feels like he/she can't install the reverse lip spacer brace 301 into the perimeter notches 126*p* and still elevating the outer and inner support members 42 & 43 into place.

Figure 9:
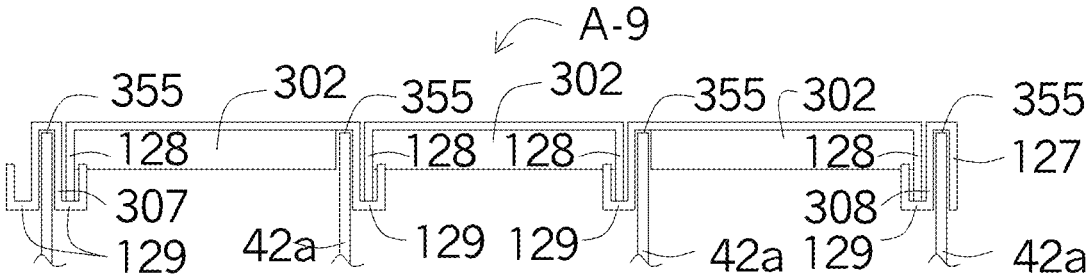
FIG. 9 shows the U-shape clip 307 on the left side installed over the bottom edge of the aperture with a spacing-bracing member having a tongue end inserted into the receiver side of the U-shape clip also shown in FIG. 10. The enlarged FIG. shows a receiver having U-shape for tongue end in FIG. 16 to fit into.
Figure 10:
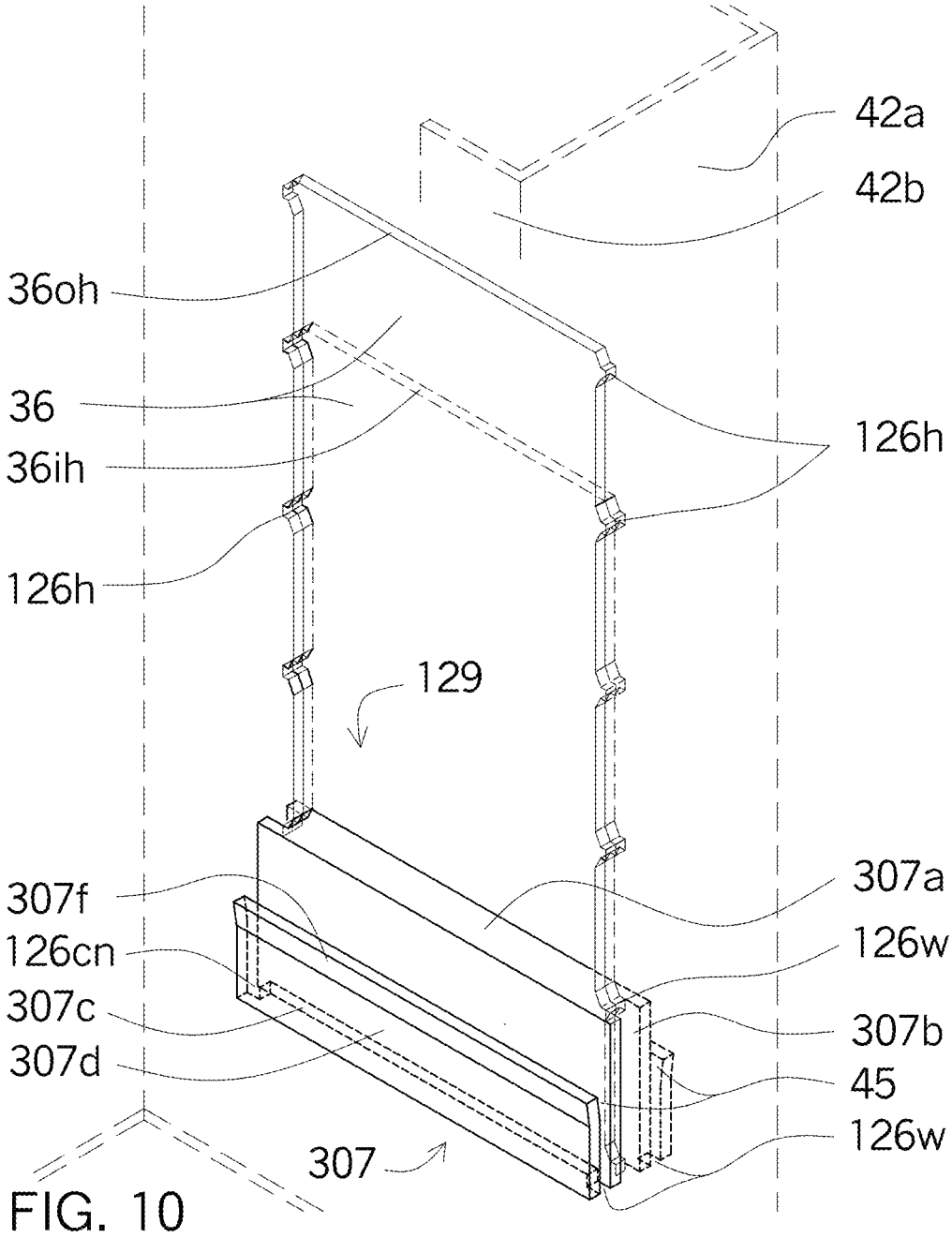

FIG. 9 and FIG. 10 shows a W-shaped clip 307 shown at the left end of a chain of various shape spacer braces and clips and shown mounted at the bottom edge 355 of an aperture. The W-shaped clip 307 can function as a U-shaped clip 308 and as a support means connecting a spacer brace 302 using the W-shaped clip 307. The W-shaped clip functions the same as the U-shaped clip where the web 307*a* extends over the hole bottom edge 36*be*, or as in FIG. 10 two-hole bottom edges 36*be* of two concentric support members. The web 307*a* is inserted and connects the perimeter notches 36*h* at the first side wall edge and the second side wall edge. The web 307*a* also has web notches 126*w* at the first and second ends that engage the perimeter notches 16*h*. The W-shaped is the flange 307*b* extends from the web 307*a* and the flange 307*b* extends further forming a hook-shape with the flange extending as the hook bottom edge 307*c* of the hook-shape and extending further shown as the hook-return 307*d*. The end of the hook-shape has a flare 307*f* edge protruding away from the flange 307*b*. The bottom edge 307*c* is shown having a web notch 126*w* at the first end and the second end of the bottom edge 307*c*. The web 307*a* also has web notches 126*w* cut where the web notches 126*w* engage the perimeter notches 126*h* at the apertures at the inner and outer concentric support members 43 & 43.

Figure 11:
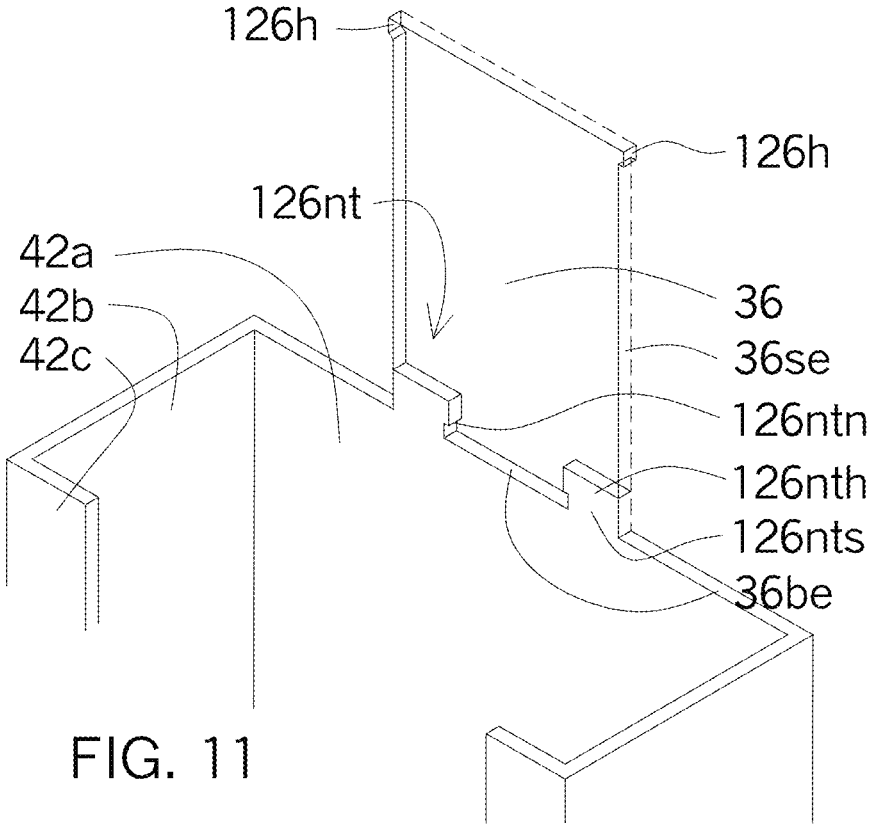
FIGS. 11-14 shows different configurations of the hook receiver 129 but shown as a W-shape clip.
Figure 12:
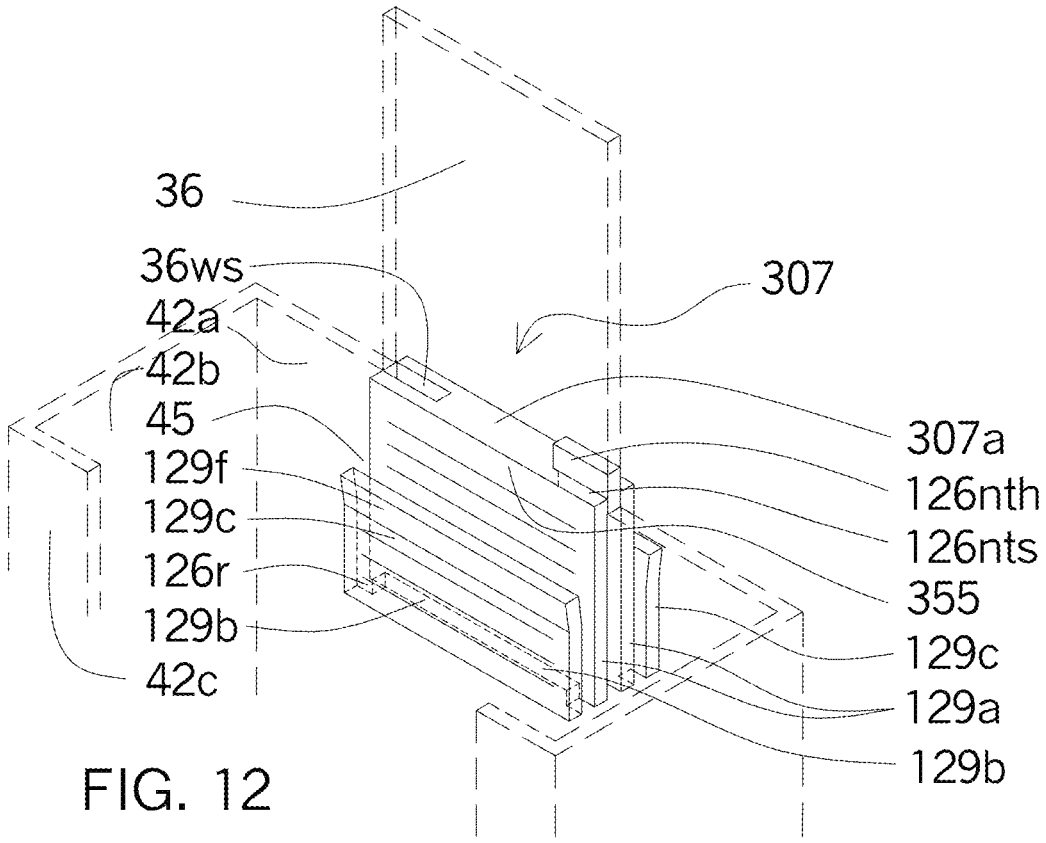
Figure 13:
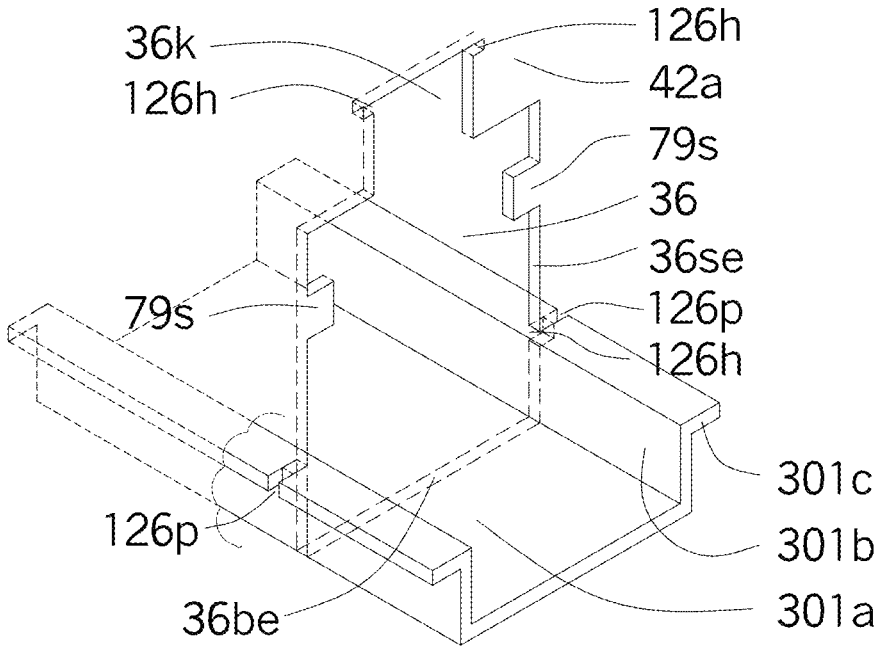
Figure 14:
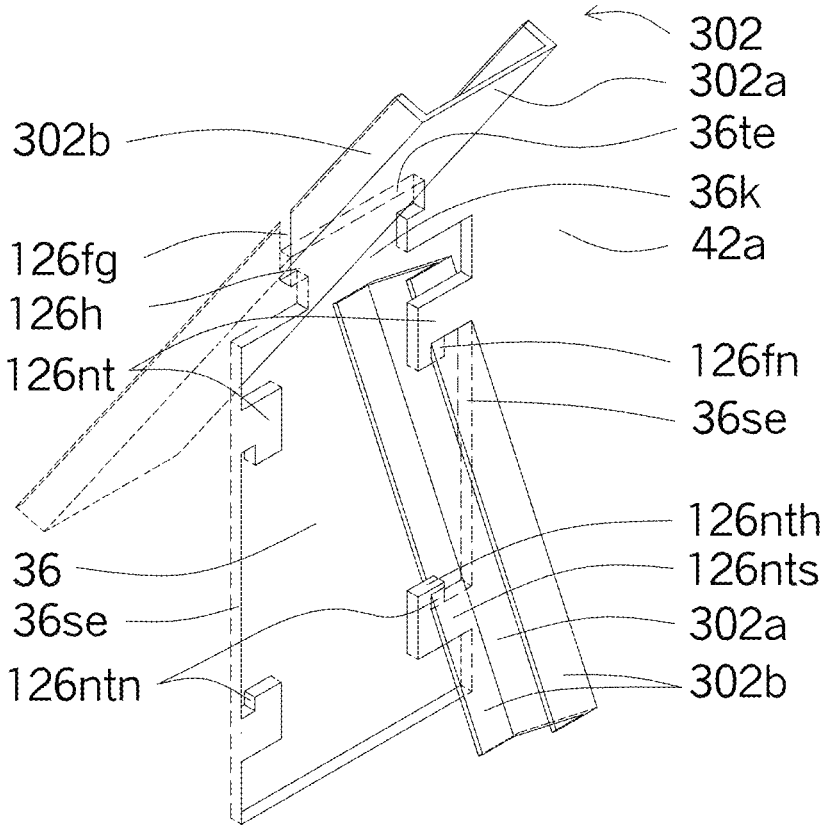

FIGS. 11-14 shows various shapes of the W-shape clip 307 similar to FIG. 9 that will allow the W-shaped clip to have a tighter fit to the web 42*a* not shown in any of the figures. The W-shape clip 307 is also referred to as a hook receiver 129 with the flanges noted as flanges 129*a*. FIG. 11 is a similar U-shaped spacer brace 307 having hooked receivers 129 on both sides with a first leg 129*a* extending downward from the web 307*a* having an outward second leg 129*b* and extending again upward forming a third leg 129*c* with a gap 45 between the first and third legs 129*a* & 129*c*. Dimples 321 are shown as one of many types of an abrasive planar surface showing a fixation connection which protrudes inward and outward in the gap 45 and inward between the first legs 129*a*. Other types of abrasive planar surfaces could be the shape of the connection, ridges, grooves, abrasive surface however, could also be a smooth surface. The fixation connection could be affected by the material used and whether the W-shape clip 307 is flexible enough to retain its shape after being moved. FIG. 12 shows a more curvilinear configuration of a fluid shape W-shaped clip 307 where the hook receivers 129 have a curved configuration between the web 307*a* and the first legs 129*a* and a curved configuration between the end of the first legs 129*a* through the second leg 129*b* to the start of the thirds leg 129*c*. FIG. 13 shows the same configuration as FIG. 55 except a flare 129*d* is shown at the end of the third leg 129*c*. FIG. 14 look like FIG. 13 except a kink 129*k* or indentation is shown on the interior side of the gap 45 between the first leg 129*a* and the third leg 129*c* so the kink 129*k* in the third leg 129*c* is tight to the first leg 129*a*.

Figure 15:
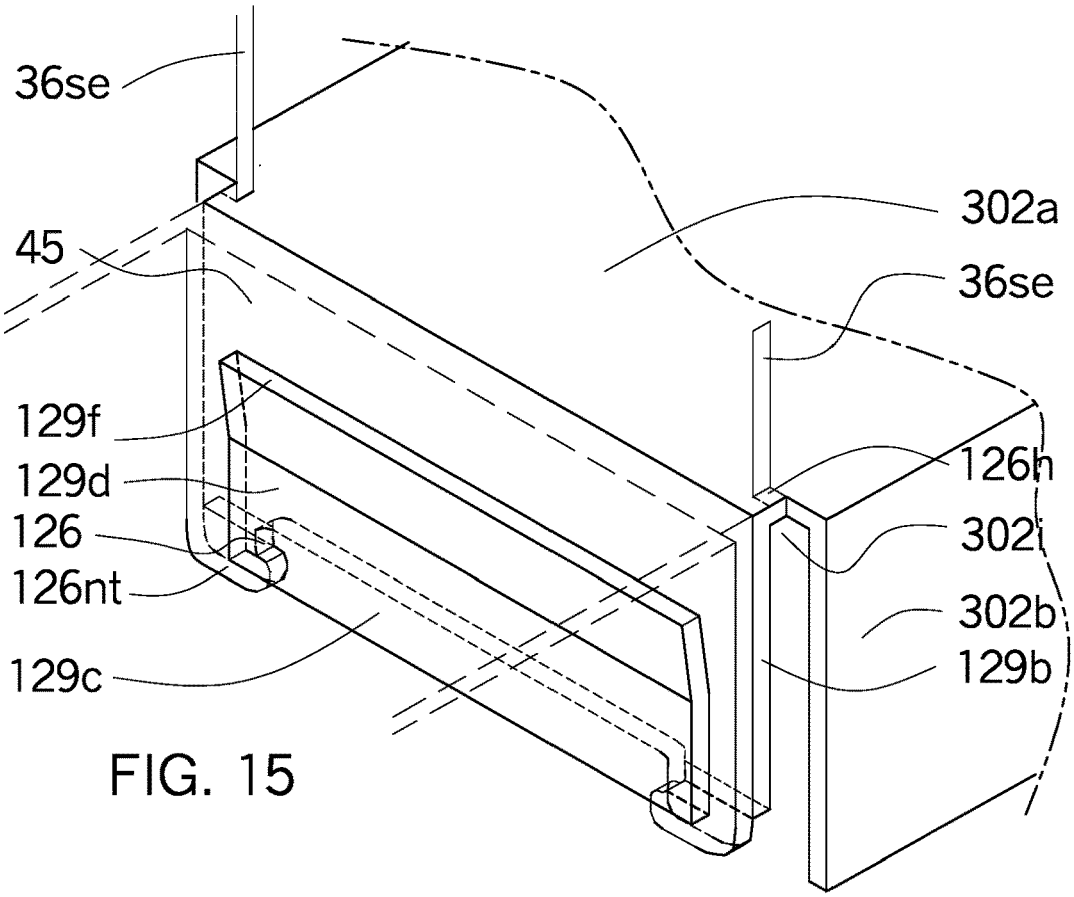
FIGS. 15 & 16 show the hook receiver end at a spacing-bracing members instead of at a C-shape clip. The hook receiver shows the hook tongue end as shown in FIG. 16 inserted into the notches of the hook receiver.
Figure 16:
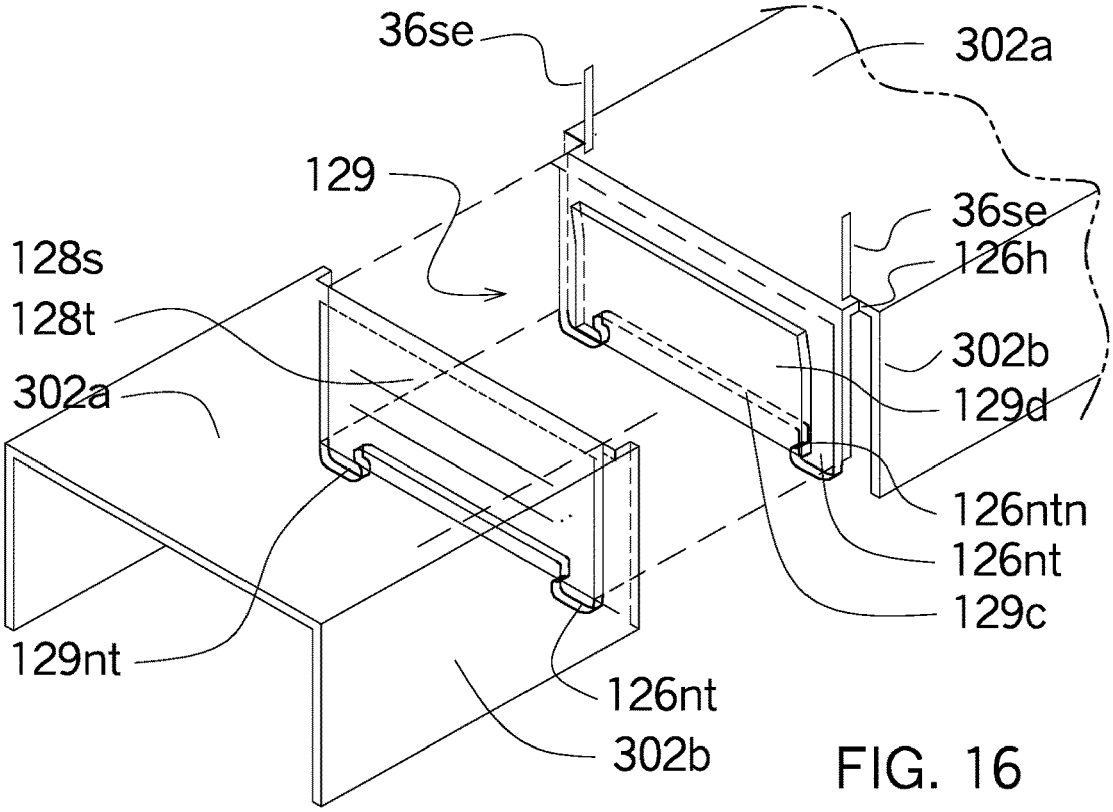

FIGS. 15 & 16 shows the hook receiver 129 with the ridges 130 attached to the hook end 129 of the U-shaped spacer brace 302. At the left side of FIG. 16, another U-shaped spacer brace 302 is shown with the opposing end having the hook tongue 128 also shown having ridges 130. When the hooked tongue 128 is inserted into the gap 45 of the hook receiver 129 the ridges 130 will interlock between each other to increase a vertical resistance force that could separate the hook tongue 128 from the hook receiver 129. The hook receivers shown in FIGS. 11-14 with the dimples 321, ridges 130, kinks 129*k* or curvilinear configurations all contribute to adding resistance between the hook tongue and hook receivers and any of the hook receivers can be added as a hook receiver at the end of the any spacer brace. The hook tongue acts as a restraining plate that rests on the anchor space 355 at the interior of the gap 45 on the second leg 129*b*. The dimples 321, ridges 130, kinks to 129*k* and the curvilinear shape of the hook tongue 128 interlock with the hook receiver to increase the resistance between each other. The left side of FIG. 16 shows the tongue side of the U-shaped spacer brace 302. In addition, the hook receiver 129 at the U-shaped spacer brace 302 shows an extension 302*e* over the anchor space 355 of the hole bottom edge 36*be*. To connect to the W-shape clip 307 the U-shaped spacer brace 302 has the flanges 302*b* abut the support member, the web 302*a* has an extension 302*e* that spans across the third leg 129*c* of the hook receiver 129 allowing the hook tongue 128 with its abrasive planar surface to extend into the gap 45 of the hook receiver 129. A spacer brace would have a hook receiver end 129*a*, 129*b*, 129*c*, 129*e* and 129*f* at the first end and a hook tongue 128 at the opposing end. The hook receiver 129 would be installed over the hole bottom edge 36*be* of the apertures of the inner and outer support members 42*i*. The flanges 302*b* could extend upward and the space brace shape could be a reverse lip spacer brace 301 having a hook receiver end 129*a*, 129*b*, 129*c*, 129*e* and 129*f* at the first end and a hook tongue 128 at the opposing end.

Figure 17:
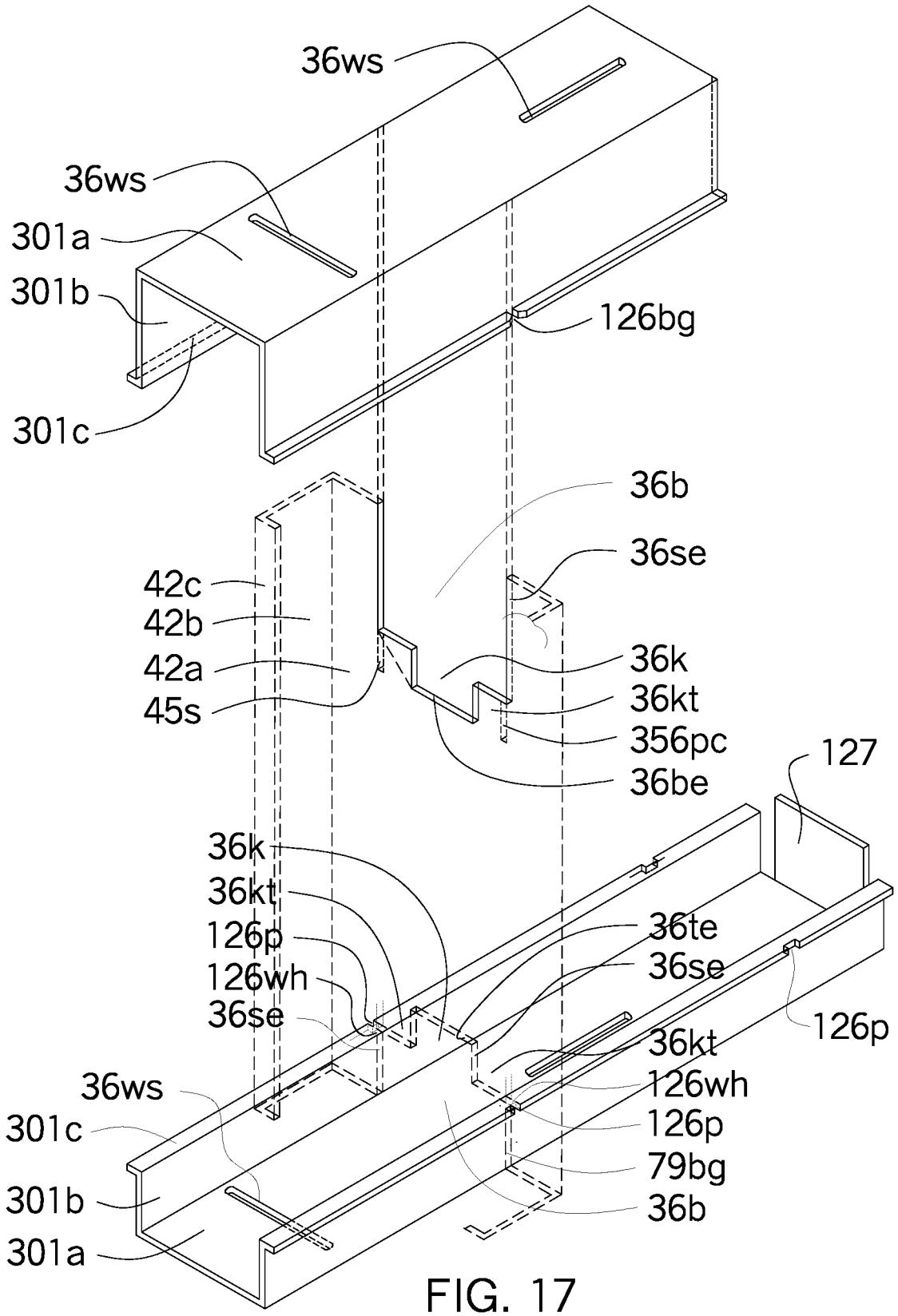
FIG. 17 shows the reverse lip spacer brace with the top end having the lip notch engage the perimeter side edges.

FIG. 17 shows two reverse lip spacer braces 301 connected by a support member shown as a C channel 42 has a web 42*a* with extending flanges 42*b* and outwardly extending lips 42*c* with longitudinal edges of the lips 42*c* having a lip notch 126*p* with a flare edge 126*f*. The reverse lip spacer brace 301 shown at the top edge of the support member is also shown in FIG. 22 and the dorsal side of the web 301*a* is against the floor. The support member is shown with the web 42*a* having two L-shaped gaps 126*e* where the flanges 301*b* and lip 301*c* would intersect the web 42*a*. The web 42*a* of the support member is narrow at the L-shaped gaps 45*e* and is wide enough for the flange 301*b* and lip 301*c* to slide into. The flange 301*b* will bend ventrally inward when the lip 301*c* and flange 301*b* are inserted into the narrow portion of the L-shaped gap 45*e* The opposing L-shaped gap 45*e* will also be inserted at the same time. The lips 301*c* will become slanted downward as pressure is applied to insert the lips 301*c* into the L-shaped gap 45*e*. The lips 301*c* could be slanted initially in order to fit into the L-shaped gap 45*e* more easily. Once the lips 301*c* are completely inserted into the L-shaped gap 45*e* the lip 301*c* will flex back into their original position when the lips 301*c* reach the web notch 126*w* at the top of the L-shaped gap 45*e*. The web gap 45*w* or a web indentation 42*ai* is more clearly shown in FIG. 3 and the lip notch 126*p* is more clearly shown in FIG. 4. When the lip notch 126*p* is oriented to the longitudinal direction of the reverse lip spacer brace 301 and the web notch 126*w* which is oriented in the direction of the C channel 42 cross, the vertical and horizontal notches become a self-locking secured connection between the two framing members. The web 42*a* between the L-shaped gaps 45*e* at the bottom edge of the support member describes the notched-tab 126*nt* with the notched-tab notches 126*ntn* and head 126*nth* as previously described in other notched-tabs.

Figure 18:
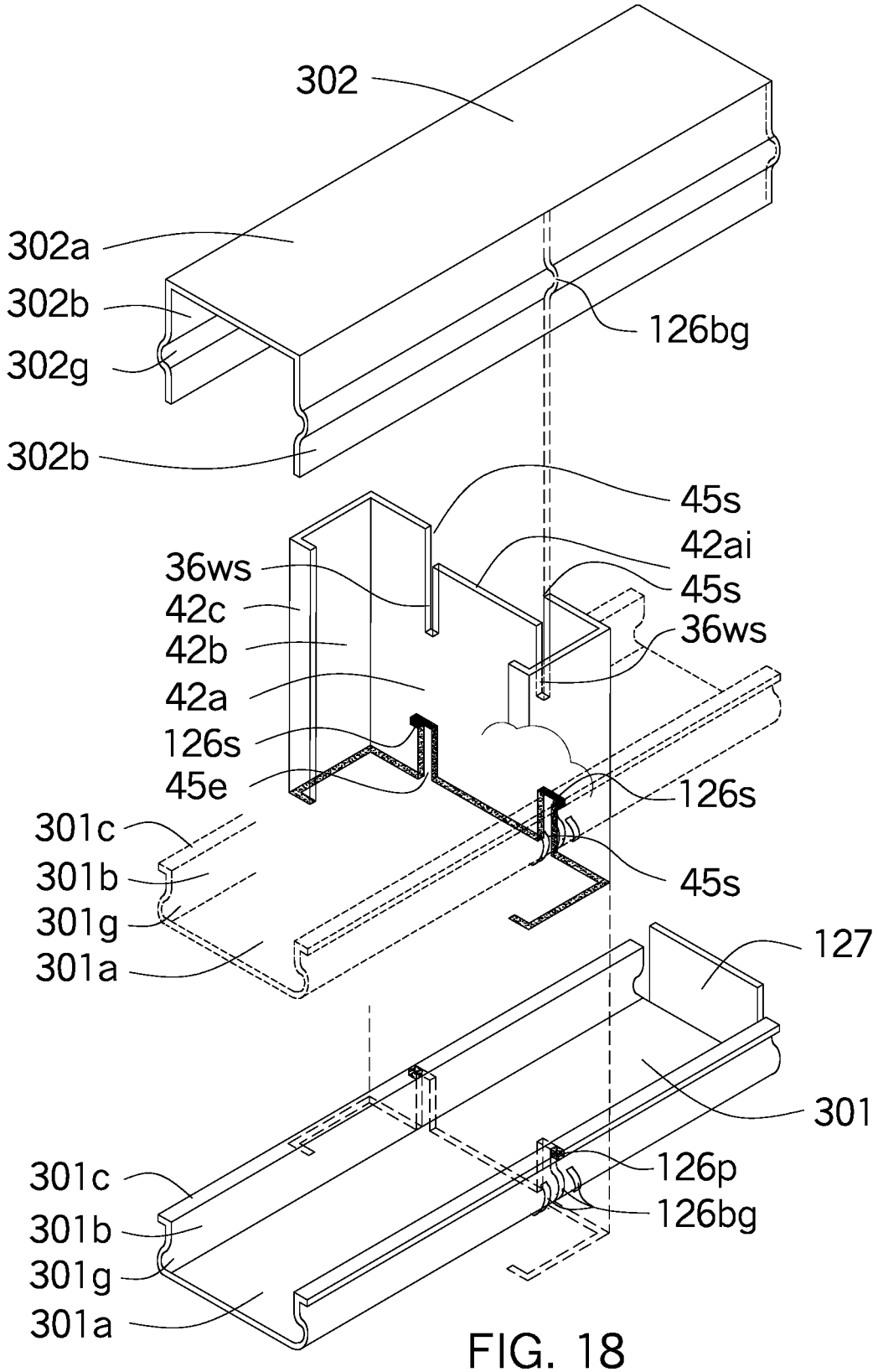
FIG. 18 shows the U-shape spacer brace at the top end with bulge notches engage the perimeter side edges.

FIG. 18 shows a U-shaped spacer brace 302 has its dorsal side of the web 302*a* mounted against the ceiling with its flanges 302*b* extending downward. A rounded shape bulge 302*g* is shown extending outward from the flange 302*b* and in the middle of the longitudinal oriented bulge 302*g* shows a bulge notch 126*bg* that is in alignment with the web 42*a* of the support member. The bottom reverse lip spacer brace 301 has the dorsal side of its web 301*a* fastened (not shown) to the floor with its flanges 301*b* extending upward and its lips 301*c* extending outward. A bulge 301*g* is shown extending outward from the web 301*a* protruding outward from the flange 301*b* so a bulge notch to 126*bg* can cut into the bulge 301*g* and aligned with the web 42*a* of the support member. Again, the top and bottom spacer braces are mounted at floor and ceiling, and the support member has its web 42*a* with its slide gaps 45*s* inserted into the flanges 302*b* & 301*b*. The bottom end of the support member has a slide gap 45*s* but shown with a slide notch 126*s* at the end and aligned so the slide notch 126*s* is on the flange sides of the slide gap 45*s*. After the web 42*a* is inserted in the flanges 301*b* at the slide gap 45*s* of the L-shaped gap 45*e*, then the lip 301*c* is inserted into the slide gap 45*s* and adjusted to fit into the two slide notches 126*s* in both slide gaps 45*s* and the support member is then slid horizontally so the web 42*a* can fit into the bulge notches 126*bg*. One end of the web 302*a* is bent to form a hook finger 127 at one end of the reverse lip spacer brace 301. At the top of the support member additional vertically oriented web slot holes 36*ws* are shown and are aligned with the slide gaps 45*s* above. Should a support member need to be cut shorter, the web slot holes 36*ws* would then be used as the slide gaps 45*s*.

Figure 19:
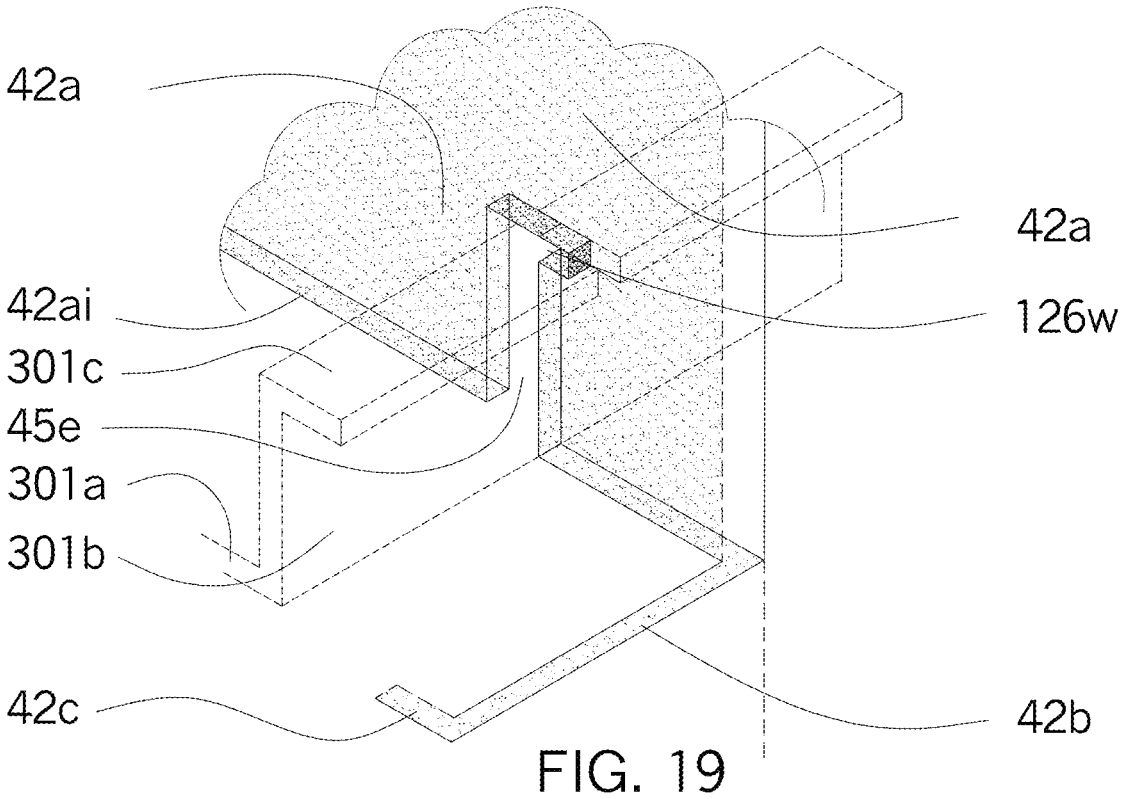
FIG. 19 shows an enlargement of the web with the L-shape gap in the web of the support member.
Figure 20:
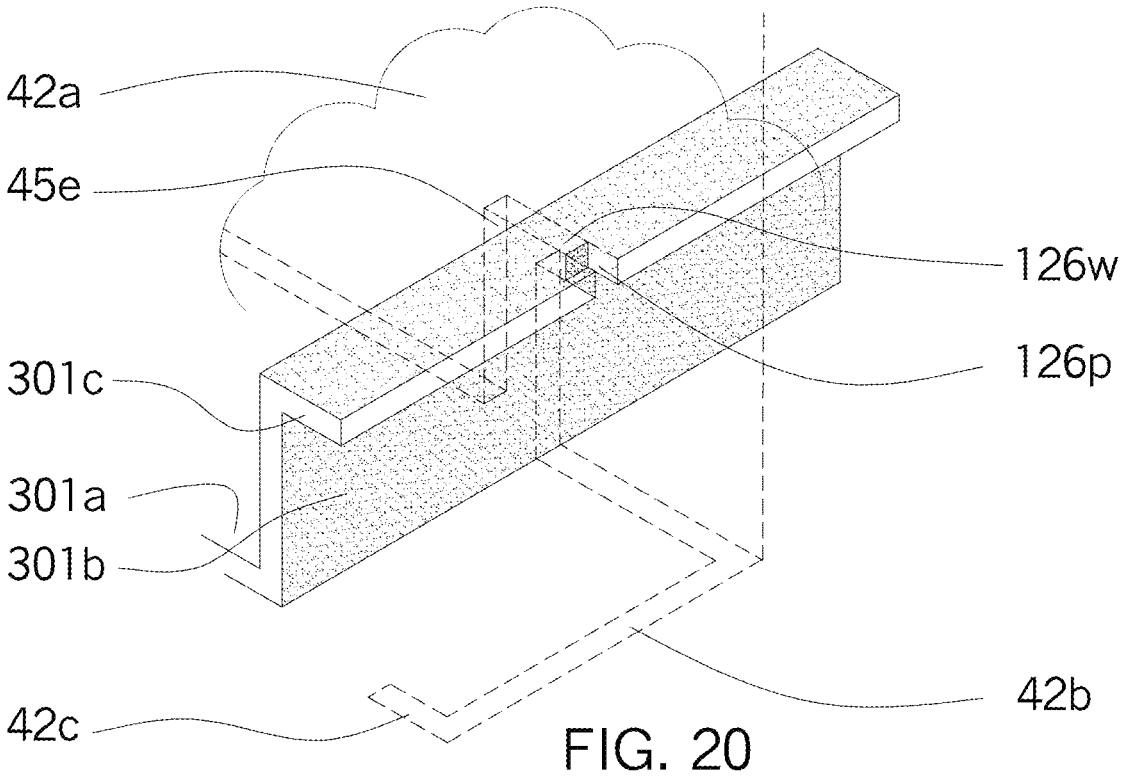
FIG. 20 shows the reverse lip spacer brace mounted directly on the floor with drywall mounted on the support member and a fire rated insulation mounted between the support members.

FIG. 19 and FIG. 20 shows an isometric drawing of an intersecting reverse lip spacer brace 301 with the web 42*a* of the support member. FIG. 19 shows the web 42*a* highlighted as shaded with the L-shape gap 45*e* at the bottom edge of the support member 42. The side edges of the L-shape gap 45*e* are angled, however as shown before the side edges can be angled. The end of the L-shape gap is shown as a web notch 126*w*. The anchor space 355 is the bottom edge of an aperture 36 and the L-shaped gap 45*e* shows the web ai of the support member 42 is slightly elevated so the web ai will be at the same level at the end of the support member 42. The head of the L-shape gap at the short L-shape is slightly wider to allow for the lip notch 126*p* shown in FIG. 4 can bend to be flexible enough to engage the L-shape gap 45*e*. In lieu of two L-shape gaps 45*e* one large aperture 36*b* having web notches 126*wh* in the corners can also be used as shown in FIG. 17.

FIG. 20 shows the reverse lip spacer brace 301 attached to the floor 40 except hardboard 331 is attached to the flanges 42*b* of the support members 42. The wallboard 331 is suspended above the floor 140 by a gap 45 that is recommended to reduce moisture penetration and allow for expansion of the wallboards 331. A fire-resistant material 334 is installed between the flanges 42*b* and over the reverse lip spacer brace 301 and is anchored to the floor 401 by an anchor bolt 354 or other available means to secure the reverse lip spacer brace 301. A fire-stop 332 is installed in the gap 45 to eliminate fire penetration between wallboards 331 and the floor 401.

FIG. 21-26 shows various applications of the reverse lip spacer brace 301 installed on the floor or on the ceiling with or without a continuous floor channel 120 or ceiling channel 120. The ceiling application allows for the reverse lip spacer brace 301 to be secured to the floor 401 or ceiling 404 or where the support channels 42 are allowed to slide in a lip notch 126*p* or a bulge notch 126*bg* (shown in FIG. 18).

Figure 21:
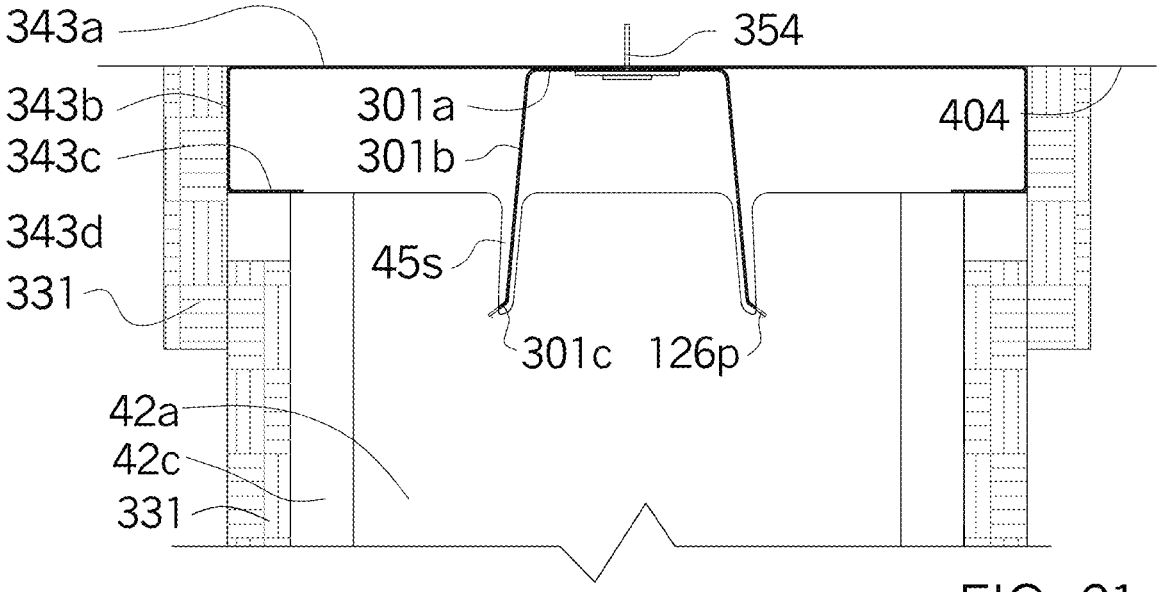
FIG. 21 through FIG. 26 shows the reverse lip spacer brace with the lip having a lip notch, however any on the FIG's can be shown as having a bulge with the bulge having a bulge notch as shown in FIG. 18 with the bulge notch 126*bg* extending into the straight hole gap 45*i* or the L-shape gap 45*e* sad the bulge notch 126*bg* engages the gap side edges of the notched web.

Another type of ceiling channel is a T-shape base channel 343 as shown in FIG. 21 where the web 343*a* is fastened to the ceiling with fasteners 122 or an anchor bolt 354. The web 343*a* is wider than the width of the support member 42 and has a flange 343*b* extending from both sides of the web 343*a* and a lips 343*c* extending from the flange 343*b* with the lips 343*c* bending inward forming a C-shape. A reverse lip spacer brace 301 is mounted on the interior side of the C-shape at the web 343*a* and fastened with an anchor bolt 354 or fasteners not shown but shown in FIG. 24. The reverse lip spacer brace with its web 301*a*, slightly angled flanges 301*b* and lips 301*c*. The lips 301*c* have lip notches 126 where the lip notches 126*p* extend at an angle so the lip notches 126*p* can engage the side edge of a sliding gap 45*s* that is cut into the top end of the support member allowing the support member to move within the lip notches 126*p* in the sliding gap 45*s*. A fire-board 331 is installed and connected with fasteners over the flange 42*b* of the support member. Another smaller fire-board 331 is installed over the first fire-board and connected with fasteners to the flange 343*b*. The fire-board 331 at the T-shape channel 343 overlaps the fire-board 331 at the support member 42.

FIG. 22 shows the reverse lip spacer brace 301 fastened directly to the ceiling with the top end of the support member has L-shape gaps 45*e* cut into the web of the support member 42. FIG. 17 shows the same reverse lip spacer brace 301 installed in the top end of the support member 42 where a large hole 36*b* is shown and where the lip notches 126*p* slide vertically against the hole side edges at the hole 36*b*. The flanges 301*b* are longer when installed as a sliding spacer brace in order for the lip notches 126*p* to be engaged to the large hole 36 side edges. The fire-board 331 is installed over the flanges 42*b* of the support member 42 and a fire stop 332 is installed between the ceiling and the fire-board 331. FIG. 23 is similar to FIG. 22 except the reverse lip spacer brace 301 is mounted to the floor rather than the ceiling.

Figure 24:
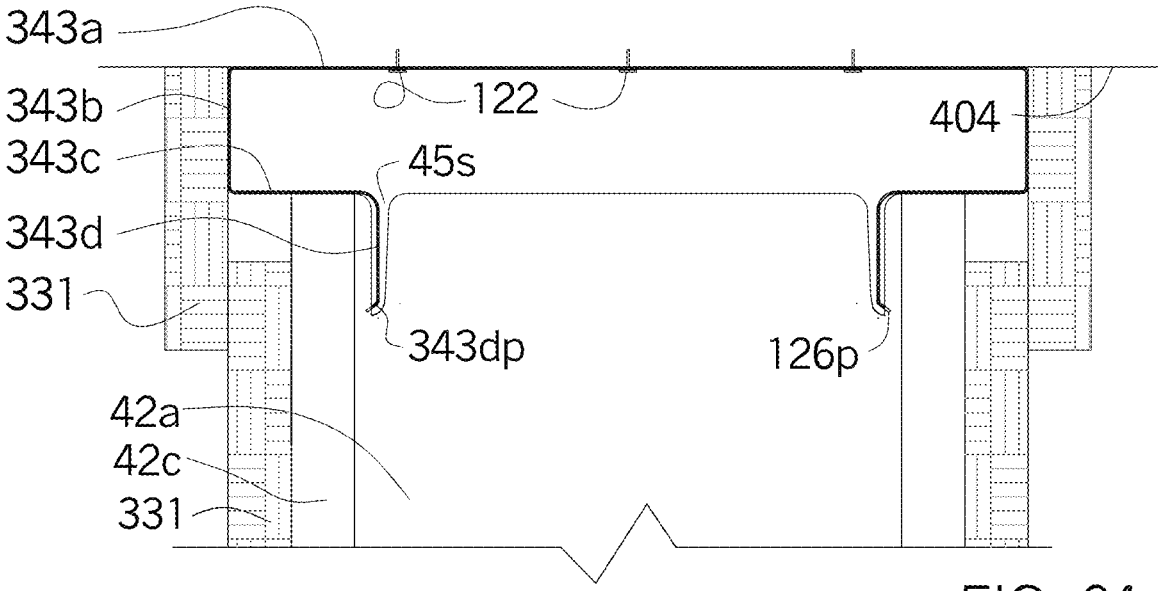

FIG. 24 is similar to FIG. 21 except the lip 343*c* is slightly longer and an extended flange 343*d* is added at the end of the lip 343*c*. The extended flange 343*d* has an extended lip 343*dp* extending from the extended flange 343*d* and the extended lip 343*dp* has an angled lip notch 126*p*. The extended flange 343*d* with the extended lip 343*dp* and lip notch 126 are installed into a slide gap 45*s* at the top end of the web 42*a* of the support member 42. Fasteners 122 are used to fix the T-shape base channel 343 to the ceiling. The lip notches 126*p* slide vertically within the slide gap 45*s* and the lip notches 126*p* also keep the support member 42 from moving horizontally as the lip notches 126*p* keep the web 42*a* from moving out of the side edges of the slide gap 45 in the support member 42.

Figure 25:
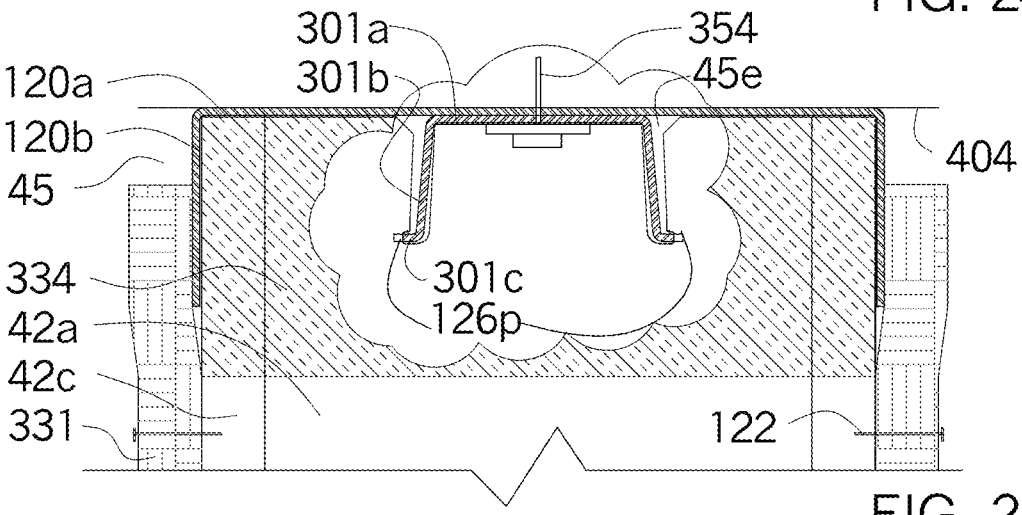
Figure 26:
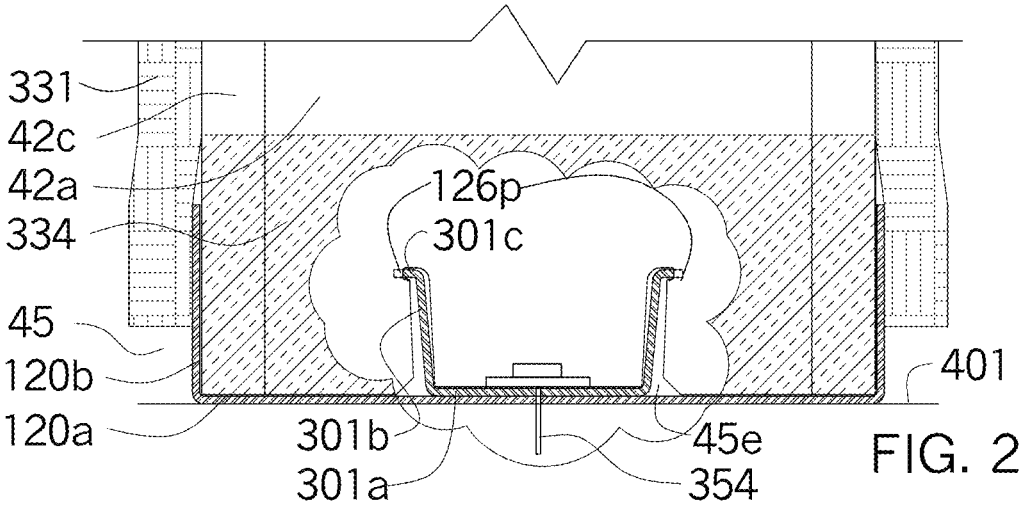

FIG. 25 and FIG. 26 are similar both FIG's having a base channel 120 with a web 120*a* and a first flange 120*b* and a second flange 120*b* extending from the web 120*a* plus a reverse lip spacer brace 301 having a web 301*a* with a first and a second flange 301*b* with lips 301*c* and lip notches 126*p* cut into the lips 301*c*. The reverse lip spacer brace 301 is mounted showing a anchor bolt 354 extending through the web 301*a* and the web 120*a* into the floor at FIG. 26 or the ceiling at FIG. 25. Both FIG's show fire board or hardboard 331 mounted on the flanges 120*b* of the base channel 120 with fire resistant material 334 similar to mineral wool insulation. The top end and bottom end of the web 42*a* in the support member 42 show an L-shape gap 45*e* cut into the web 42*a* where the lip 301*c* engages into the L-shape gap 45*e* and the lip notch 126*p* engage the short end of the L-shape gap 45*e* to keep the support member 42 from moving horizontally.

No additional FIG's are shown, however when the profile of FIG. 23 is installed over the profile of FIG. 22, the web 301*a* of FIG. 23 abuts the web 301*a* of FIG. 22. Fasteners are used to connect between the first and second connector members 301. The back-to-back connection of the connector members 301 is another method to connect the L-shape gap 45*e* at an inner support member 42*i* extension to the L-shaped gap 45*e* at an outer support member 42*o*. The same connection can be used for the ceiling construction when the connector member 301 is braced at the ceiling structure on the building construction.

No additional FIG's are shown, however FIG. 22 and FIG. 23 or FIG. 25 and FIG. 26 could have the web 301*a* of the reverse lip spacer channel 301 or web 120*a* of the base channel 120 able to connect to a wall structure (masonry or concrete wall) or a metal framed wall structure using fasteners 122 into the wall construction to form a metal framed ceiling construction using the inner and the outer concentric support members as the horizontal framing members and the appropriate support hangers from the building ceiling structural system.

It is understood that the invention is not to be limited to the exact details of operation or structures shown and describing in the specification and drawings, since obvious modifications and equivalents will be readily apparent to those skilled in the art. The flexibility of the described invention is very versatile and can be used in many different types of building applications.

Term Summary

36 hole or aperture; 36*se*—hole side edge, 36*be*—hole bottom edge, 36*the*—hole top edge, 36*i*—inside aperture, 36*o*—outside aperture

42 support member—C—shape, 42*a*—web, 42*b*—flange, 42*c*—lip

42*o* outer support member—42*oa*—outer web, 42*ob*—outer flange, 42*oc*—outer lip,

42*ia*—inner web, 42*ib*—inner flange, 42*ic*—inner lip, 42*the*—top edge

43—inner support member—U-shape—43*oa*—outside web, 43*ob*—outside flange, 43*ia*—inside web, 43*ib*—inside flange, 43*dt*—indentation

45 gap, 45*e*—L-shaped gap, 45*s*—slide gap, 45*t* T-shape gap

120 base channel, a—web, b—flange, 120*bg*—bulge

126 notch, 1*tp* 26*p*—lip notch, 126*w*—web notch, 126*pp*—double lip notch, 126*tp*—tapered notch, 126*f*—flare edge

126 notch, 126*p*—lip notch, 126*w*—web notch, 126*pp*—double lip notch, 126*tp*—tapered notch, 126*f*—flare edge, 126*h*—hole notch, 126*cr*—corner, 126*be*—bottom edge, 126*the*—top edge, 126*se*—side edge, 126*de*—sloped side edge, 126*e*—L-shape notch, 126*bg*—bulge notch, 126*be*—bottom edge, 126*the*—top edge, 126*se*—side edge

127 hook finger, bent arm

128 hook tongue; 128*a*—first side, 128*b*—second side, 128*w* wide hook tongue, 128*f*—flare, 128*tf*—tongue flap, 128*tt*—tongue tab, 128*s*—tongue shaft, 128*i*—tongue indentation

129 hook receiver, 129*sh*—receiver slot hole, 129*a*—first leg, 129*b*—second leg, 129*c*—third leg, 129*d*—fourth leg, 129*f*—flare, 129*k*—kink

301 reverse lip spacer brace, 301*a*—web, 302*b*—flange, 302*c*—lip, 301*e*—extension, 301*g*—bulge, 301*ce*—extended lip, 301*cc*—lip extension, 301*bb* extended side wall

302 U shaped spacer brace, 302*a*—web, 302*b*—flange, 302*c*—lip, 302*g*—bulge

302 U-shape bracing member. 302*a*—web, 302*b*—flange, 302*g*—bulge

307 W-shaped clip: 307*a*—web, 307*b*—flange, 307*e*—elongated W-shaped clip, 307*f*—flange

308 U-shape clip, 308*a*—web, 308*b*—flange

321 dimples

331 fire board or hardboard or fire rated material

332 fire stop

334 fire resistant material

343 T-shape base channel, 343*a*—web, 343*b*—flange, 343*c*—lip, 343*d*—extending leg, 343*dp*—extending lip.

354 anchor bolt

401 floor

404 ceiling

The invention claimed is:

1. A structural framing system comprising an expandable support member having an outer support member and an inner support member attached to a plurality of connector members comprising:

said outer support member having an outer web attached to a first outer flange extending away from said web, said first outer flange attached to a first lip extension said outer web attached to a second outer flange extending away from said web, said second flange attached to a second lip extension together forming a C-shaped configuration having an outside planar side and an inside planar side, and having a first end and a second end; said inner support member having an inner web attached to a first inner flange, said inner web attached to a second inner flange together forming a U-shape configuration with the configuration having an outside planar side and an inside planar side, and having a first end and a second end, said outer support member at said inside planar side extends around the outside planar side of said inner support member secured by friction between said inside and outside planar sides to said inside planar side of said outer support member;

said outer support member has an outside aperture cut into said outer web setback from the second end of the outer support member and said inner support member has an inside aperture cut into an inner web setback from the first end of the inner support member, said outside aperture and said inside aperture overlap and are aligned horizontally forming an overlapping aperture, each said inside aperture and said outside aperture has a first perimeter side edge and a second perimeter side edge opposite said first perimeter side edge, and a third perimeter side edge opposite a fourth perimeter side edge being a bottom perimeter edge, said first perimeter side edge and said second perimeter side edge has an array of perimeter hole notches cut into said first perimeter side edge and cut into said second perimeter side wall edge, the first perimeter hole notches at said outside aperture are aligned with the perimeter hole notches at said inside aperture, enabling said first and second perimeter hole notches at said outer support member to be offset from said first and said second perimeter hole notches at said inner support member by adjusting height variation positions between said perimeter hole notches at said inside and said outside apertures;

said overlapping aperture enables a first one of the connectors to engage with aid first and said second perimeter hole notches; said one of the connectors has a connector web attached to a first connector flange, said connector web attached to a second connector flange, said connector web having a first end with a cut into said connector web forming a first connector web notch to engage said first perimeter hole notches, said connector web having a second end with a cut into said second connector web notch forming a second connector web notch to engage said second perimeter hole notches at said overlapping aperture, or a second one of the connectors having with a connector web an attached to a first connector flange with an extending first connector flange, said connector web having an attached opposing second connector flange with an extending second flange, said extending first connector flange has a flared distal edge with a first connector notch cut into the distal edge, said extending second flange having a flared distal edge with a second flange connector notch cut into the distal edge, said second one of the connectors has a first end and a second end, said first and said second flange connector notch setback from said first end and said second end enable to engage said overlapping aperture at said expandable support member; or a third one of the connectors having a perimeter hole notch connection having a first flange with an attached first lip having a cut into a distal edge forming a first lip notch, said third connector having a second flange with an attached second lip having a cut into the distal edge forming a second lip notch, said first and said second lip notch setback from the first end and the second end to engage said overlapping aperture at said expandable support member.

2. The structural framing system according to claim 1 further comprising said second connector with a length able to connect said first expandable support member to a second expandable support member having a first end and a second end, said first end and said second end has said first and said second flange connector notch at said second connector member configuration or said third connector member configuration has said lip notch setback from said first end to engage said overlapping aperture having said outside and said inside aperture, said second end to engage a second overlapping aperture at said adjacent support member with a third and a fourth lip notch setback from said second end to engage said overlapping aperture of said adjacent support member or said third connector member configuration having said lip notch.

3. The structural framing system according to claim 2 wherein said first lip notch and said second lip notch have angular cutouts in relation to the longitudinal direction of said first connector and angular cutout at said first lip notch being offset to angular cutout of said second lip notch.

4. The structural framing system according to claim 2 wherein said first connector has said connector web with said first and said second side walls have angular side walls extending from said web.

5. The structural framing system according to claim 2 wherein said perimeter notches at said overlapping aperture have multiple perimeter notches to adjust and align aid perimeter notches a continuous notched opening to engage one of said connectors.

6. The structural framing system according to claim 5 wherein said overlapping aperture has said first connector with said first and second lip notch to connect said inside planar wall and said outside planar wall at said first and said second perimeter side edge of said inner support member and, said first and said second lip notch connect said inside planar wall and said outside planar wall at said first and said second perimeter side edge of said outer support member, said first connector having a first pair of said first and said second lip notches setback from said first end and a second pair of a third lip notch and a fourth lip notch setback from said second end, said second end to engage an adjacent second inner and outer support member engaging said second pair of lip notches at said second end.

7. The structural framing system according to claim 1 wherein said connectors comprise bulges protruding from said first and said second side edges, with said first and second bulges having bulge notches, said bulge notches are cut at an angle and offset between said first and said second bulges, said bulge notches engage said first and said second perimeter notches.

8. The structural framing system according to claim 1 wherein said second connector member has said connector web attached to said first side wall and said second side wall forming a U-shape configuration, said connector web engage a first perimeter side edge at said first perimeter side wall notch and having said second end of said connector web engage said second perimeter side wall notch with said first side wall and said second side wall extending from said connector web, past said first and said second perimeter notch, forming a first connector notch and a second connector notch as said connector web, said second connector member configuration connects said perimeter wall notches at said outside and said inside apertures together with a first web notch and a second web notch connecting said perimeter wall notches.

9. The structural framing system according to claim 1 wherein said inner support member has said inner web with an attached said first inner flange and said inner web with an attached said second inner flange, said inner web connected to first inner flange forming a first bulge corner, and an opposing second inner flange extending outward planar side toward said inside planar side of said outer support member, said inner support member with said inner web forming a second bulge corner, said first and said second bulge corners extend beyond said inner web and beyond said first and said second inner flange leaving said first and said second bulge corners being the friction contact point between said inside planar side of said outer support member and said outside planar side of the inner support member, said first and said second inner flange having a free edge with said free edge extending outward toward said inside planar side of said outer support member.

10. A connection comprising an expandable support member having an outer support member overlapping an inner support member secured by connector members;

said outer support member having a C-shape configuration with an outer web attached to a first flange with said first flange having a first lip and said outer web attached to a second flange with said second flange having a second lip opposite said first flange with said first lip, said outer support member encompasses an outside planar surface and an inside planar surface with a top end and a bottom end, said bottom end connected to a floor connector member and said top end connected to:

said inner support member having with an inner web having an attached first flange with said inner web attached to a second flange, said inner support member having an outside planar surface and an inside planar surface able to slide said outside planar surface of said inner support member against said inside planar surface of said outer support member, and a top end and a bottom end said bottom end connected to said outer support member with said top end connected to a ceiling connector member;

said outer support member has an outer aperture cut into said outer web setback from said second end of said outer support member, said inner support member has an inner aperture cut into said inner web setback from said first end of said inner support member, said outside aperture overlaps said inside aperture forming an overlapping aperture, said overlapping aperture has a first perimeter edge and a second perimeter edge opposite said first perimeter edge, and a third perimeter edge opposite a fourth perimeter edge between said first perimeter edge and said second perimeter edge, said first perimeter edge and said second perimeter edge has an opening cut into said first perimeter edge forming a first perimeter notch and a second perimeter notch cut into said second perimeter edge forming a first pair of said perimeter notches, said inside aperture in alignment between said inside and said outside aperture with, said perimeter notches at said overlapping aperture able to adjust and align said perimeter notches at said inner support member with said perimeter notches of said outer support member to the desired length of said expandable support member;

said expandable support member at said outer support member at said first end and said inner support member at said second end each have a distal edge, said first end has a first aperture with a cutout into said outer web at said first end, comprising a first L-shaped gap configuration and a second L-shaped gap configuration, each cutout having a long leg gap connecting to a short leg gap, said short leg gap projecting toward said first flange and said second short leg projecting toward said second flange;

said expandable support member at said inner support member has a second aperture with a cutout in said outer web at said second end comprising a third L-shaped gap configuration and a fourth L-shaped gap configuration each cutout has an open gap at the distal end of a long leg gap connecting to a short leg gap, with the short leg gap projecting toward said first flange and said second short leg projecting toward said second flange, said expandable support member at said inner support member has a second apertures with a cutout in said outer web at said second end comprising a third L-shape gap configuration and a fourth L-shaped gap configuration each cutout has an open gap at the distal end of a long leg gap connecting to a short leg gap projecting toward said first flange and said second short leg projecting toward said second flange, said expandable support member with said inner and said outer apertures have said connector members to engage said L-shape gaps and said perimeter hole notches, said connector members having a web with a first side wall, said web with a second side wall, with a first side wall notch cut into said first side wall and a second side wall notch cut into said second side wall, said first and said second side wall able to bend to engage said L-shape gaps and said perimeter hole notches with said first and said second wall notch, said connector members engaging said outer aperture, said inner aperture or said overlapping aperture having said first side wall having a first lip with a first lip-connector notch cut into said first lip and said second side wall has a second lip with a second lip-connector notch cut into said second lip connecting said expandable support member together.

11. The connection according to claim 10 wherein said first or said second aperture and said third or fourth aperture has said first and said second perimeter notches with a narrow width notch opening for said connection member with a web with a first side edge and a second side edge opposite said first side edge, with a first end having a first flange and a second end having a second flange, said first flange abuts against the inside plane of said inner support member and said second flange abuts against the outside plane of said outside support member with said first side edge and said second side edge have a web notch with an indentation cut into said first side edge and said second side edge able to be pressured into said back notch edge of said first and second perimeter notch and against said inside planar side and said outer planar side of said outer and said inner support members.

12. The connection according to claim 10 wherein the pair of said first perimeter notches or said second perimeter notches has said cut opening with a wide width at said cut opening tapering to a narrow back width.

13. The connection according to claim 10 wherein the pair of said first perimeter notches or said second perimeter notches engage said top edge, back edge, and bottom edge side wall notches said connection member.

14. The connection according to claim 10 wherein said first connection member overlaps a second connection member of an equal or smaller width from the opposing directions at said first aperture and said second aperture requiring said first and second perimeter notches to have a wide width to engage said first and second wall notches together within the same perimeter notch.

15. The structural framing system according to claim 10 wherein said connector member has fasteners holes in said web to secure said web to a floor, or a ceiling, or a wall building construction, or when connecting back-to-back connector members together at said web.

16. The structural framing system according to claim 10 wherein said two L-shaped gaps at the second end of said inner support member and said two L-shaped gaps at the first end of said outer support member may have said T-shaped gaps or L-shaped gaps.

17. The structural framing system according to claim 10 wherein said two L-shaped gaps at the second end of said inner support member and said two L-shaped gaps at the first end of said outer support member, may have said L-shaped gaps at both ends of said outer and said inner support member.

18. A method of erecting an expandable wall structure comprising:

attaching a second connector member to a ceiling, attaching a first connector member to a floor, said first and said second connector has a connector web attached to a first connector flange, said connector web attached to a second connector flange, said first and said second connector flange has a first and a second extending flange with extending flange notches;

an expandable support member having an outer support member overlapping a comparably similar smaller inner support member, said inner support member having an outer web attached to a first outer flange and said outer web attached to a second outer flange, a first lip attached to said first outer flange and a second lip attached to said second outer flange, able to overlap said inner support member with an inner web attached to a first inner flange and a second inner flange, said first end of said outer support member and said second end of said inner support member each having a pair of L-shape apertures cut into the distal edge of said inner web and said outer web, said second end of said outer support member and said first end of said inner support member each having a notched aperture with a first perimeter side wall notch and a second perimeter side wall notch opposed to said first perimeter side wall notch, said first and said second perimeter side wall notch with an indentation cut into each perimeter side wall, said first notched aperture and said second notched aperture setback from said respective ends each having perimeter notches cut into the perimeter side wall notches;

attaching said outer support member able to overlap said inner support member with said first and said second notched aperture able to overlap and sliding between each other;

attaching the first and second flange extension notches at said first connector member into said first end of the L-shaped apertures at said outer support member by pressuring said first and said second flange extension notches to bend under pressure engaging said L-shaped apertures;

attaching said inner support member by sliding said inner support member with the L-shaped apertures to extend into the first and second flange extension notches at said second connection member;

attaching by aligning said perimeter side hole notches at said inner notched aperture with said perimeter side hole notches at said outer support member by pressuring said inner support member into said L-shaped apertures for a tight connection at said perimeter hole notches;

attaching by installing a third connector member into said inner and said outer notched aperture, said third connector member having a connector web attached to a first-third flange, said connector web attached to a second-third flange, said first and said second-third flange having a connector lip with a connector lip notch, each said connector lip notch cut into the distal edge of said connector lip to engage said first and said second notched apertures, adjusting said perimeter aperture notches to align;

attaching by inserting a third connection member into and through said inside and said outside notched aperture wherein said third web has a first web notch and a second web notch to engage said first and said second perimeter aperture notches at said overlapping aperture; or attaching said first end of said connector member having said first and said second-third wall notches setback from said first end to engage the overlapping aperture at said first aperture at said first expandable support member, with the second end having an additional first and said second-third wall notches setback from said second end to engage the overlapping aperture at a similarly identical second expandable support member-by pressuring said clip or connection member into the perimeter notches and, or the third connection member with the first and said second-third wall notches setback from said second end;

attaching by installing a fire resistant insulation to framing members as required by building codes;

attaching by abutting and connecting a wall board with fasteners against said inner and said outer support members; and attaching by installing fire caulking if required by building codes.

* * * * *